US007858278B2

(12) United States Patent
Ikuno et al.

(10) Patent No.: US 7,858,278 B2
(45) Date of Patent: Dec. 28, 2010

(54) ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

(75) Inventors: Hiroshi Ikuno, Yokohama (JP); Masafumi Ohta, Susono (JP); Tomoyuki Shimada, Shizouka (JP); Yuuji Tanaka, Fujinomiya (JP); Hongguo Li, Numazu (JP)

(73) Assignee: Ricoh Company Limited, Tokyo (JP)

( * ) Notice: Subject to any disclaimer, the term of this patent is extended or adjusted under 35 U.S.C. 154(b) by 541 days.

(21) Appl. No.: 11/750,570

(22) Filed: May 18, 2007

(65) Prior Publication Data

US 2007/0269729 A1 Nov. 22, 2007

(30) Foreign Application Priority Data

May 18, 2006 (JP) ..... 2006-139273
May 18, 2006 (JP) ..... 2006-139275
Aug. 30, 2006 (JP) ..... 2006-233068

(51) Int. Cl.
*G03G 5/147* (2006.01)

(52) U.S. Cl. ..... 430/66; 430/59.6; 430/67; 399/159

(58) Field of Classification Search ..... 430/59.6, 430/66, 67; 399/159
See application file for complete search history.

(56) References Cited

U.S. PATENT DOCUMENTS

| | | | | |
|---|---|---|---|---|
| 4,962,008 | A | 10/1990 | Kimura et al. | |
| 5,008,172 | A * | 4/1991 | Rokutanzono et al. | 430/67 |
| 6,432,596 | B2 | 8/2002 | Ikuno et al. | |
| 6,641,964 | B2 * | 11/2003 | Ikuno et al. | 430/66 |
| 6,686,114 | B2 | 2/2004 | Sakon et al. | |
| 6,861,188 | B2 | 3/2005 | Ikegami et al. | |
| 6,899,983 | B2 | 5/2005 | Tamoto et al. | |
| 6,902,857 | B2 | 6/2005 | Yagi et al. | |
| 7,018,755 | B2 | 3/2006 | Ikegami et al. | |
| 7,112,392 | B2 | 9/2006 | Shimada et al. | |
| 7,175,957 | B2 | 2/2007 | Suzuki et al. | |
| 7,179,573 | B2 | 2/2007 | Suzuki et al. | |
| 2003/0138718 | A1 | 7/2003 | Yagi et al. | |
| 2005/0008957 | A1 | 1/2005 | Ikegami et al. | |
| 2005/0158641 | A1 | 7/2005 | Yanagawa et al. | |
| 2005/0221210 | A1 | 10/2005 | Suzuki et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2006/0014093 | A1 | 1/2006 | Li et al. | |
| 2006/0110668 | A1 | 5/2006 | Kawasaki et al. | |
| 2006/0160003 | A1 | 7/2006 | Nagai et al. | |

FOREIGN PATENT DOCUMENTS

| | | | |
|---|---|---|---|
| JP | 52-36016 | | 9/1977 |
| JP | 59-71057 | | 4/1984 |
| JP | 63-80262 | | 4/1988 |
| JP | 64-35448 | | 2/1989 |
| JP | 1-205171 | | 8/1989 |
| JP | 4-120548 | | 4/1992 |
| JP | 5-165244 | | 7/1993 |
| JP | 7-333881 | | 12/1995 |
| JP | 8-15887 | | 1/1996 |
| JP | 8-123053 | | 5/1996 |
| JP | 8-146641 | | 6/1996 |
| JP | 08-179522 | * | 7/1996 |
| JP | 10-063026 | * | 3/1998 |
| JP | 10-246978 | | 9/1998 |
| JP | 10-288845 | | 10/1998 |
| JP | 10-333346 | * | 12/1998 |
| JP | 2000-181096 | | 6/2000 |
| JP | 2002-229227 | | 8/2002 |
| JP | 2002-268257 | | 9/2002 |
| JP | 2002-341571 | | 11/2002 |
| JP | 2003-84475 | | 3/2003 |
| JP | 2003-91083 | | 3/2003 |
| JP | 2003-149849 | | 5/2003 |
| JP | 2003-302775 | | 10/2003 |
| JP | 2005-107490 | | 4/2005 |
| JP | 2006-53262 | | 2/2006 |
| JP | 2006-63341 | | 3/2006 |
| JP | 2006-119594 | | 5/2006 |

OTHER PUBLICATIONS

Lewis, R.J., Sr., ed., Hawley's Condensed Chemical Dictionary, 13th edition, Van Nostrand Reinhold, NY (1997), pp. 996-997.*
Japanese Patent Office machine-assisted translation of JP 10-333346 (pub. Dec. 1998).*
Japanese Patent Office machine-assisted translation of JP 10-063026 (pub. Mar. 1998).*
Japanese Patent Office machine-assisted translation of JP 08-179522 (pub. Jul. 1996).*
U.S. Appl. No. 12/000,239, filed Dec. 11, 2007, Fujiwara, et al.

(Continued)

*Primary Examiner*—Janis L Dote
(74) *Attorney, Agent, or Firm*—Oblon, Spivak, McClelland, Maier & Neustadt, L.L.P.

(57) ABSTRACT

An electrophotographic photoreceptor is provided, including an electroconductive substrate and a photosensitive layer located overlying the electroconductive substrate, wherein an outermost layer of the electrophotographic photoreceptor includes a resin including a graft copolymer in which a monomer having a polar group is graft polymerized to a polycarbonate resin, a polyarylate resin, or a copolymer thereof, and a filler; along with an image forming apparatus and a process cartridge using the electrophotographic photoreceptor.

16 Claims, 8 Drawing Sheets

OTHER PUBLICATIONS

U.S. Appl. No. 12/035,016, filed Feb. 21, 2008, Iwamoto, et al.
U.S. Appl. No. 12/047,011, filed Mar. 12, 2008, Kami, et al.
Office Action issued Aug. 31, 2010, in Japanese Patent Application No. 2006-139273, filed May 18, 2006.
Office Action issued Aug. 31, 2010, in Japanese Patent Application No. 2006-139275, filed May 18, 2006.
Office Action issued Sep. 30, 2010, in Japanese Patent Application No. 2006-233068, filed Aug. 30, 2006.

* cited by examiner

ELECTROPHOTOGRAPHIC PHOTORECEPTOR, AND IMAGE FORMING APPARATUS AND PROCESS CARTRIDGE USING THE ELECTROPHOTOGRAPHIC PHOTORECEPTOR

BACKGROUND OF THE INVENTION

1. Field of the Invention

The present invention relates to an electrophotographic photoreceptor. In addition, the present invention also relates to an image forming apparatus and a process cartridge using the electrophotographic photoreceptor.

2. Discussion of the Background

Electrophotography is one form of image forming method and typically includes the following processes:

(1) charging a photoreceptor in a dark place (charging process);

(2) irradiating the charged photoreceptor with light containing image information to selectively decay the charge on a lighted area of the photoreceptor, resulting in formation of an electrostatic latent image thereon (light irradiating process);

(3) developing the electrostatic latent image with a developer including a toner comprising a colorant and a binder to form a toner image on the photoreceptor (developing process);

(4) optionally transferring the toner image to an intermediate transfer medium (first transfer process);

(5) transferring the toner image, either directly or from the intermediate transfer medium, onto a receiving material such as a receiving paper ((second) transfer process);

(6) heating the toner image to fix the toner image on the receiving material (fixing process); and (7) cleaning the surface of the photoreceptor (cleaning process).

In such image forming methods, requisites (i.e., required electrophotographic properties) for the photoreceptors are as follows:

(1) to be able to be charged so as to have a proper potential in a dark place;

(2) to have a high charge retainability (i.e., to keep the charge well in a dark place); and (3) to rapidly decay the charge thereon upon application of light thereto (i.e., the potential of a lighted-area is low).

Until now, photoreceptors in which one of the following photosensitive layers is formed on an electroconductive substrate have been used:

(1) layers mainly including selenium or a selenium alloy;

(2) layers in which an inorganic photoconductive material such as zinc oxide or cadmium sulfide is dispersed in a binder resin;

(3) layers using an organic photoconductive material such as azo pigments and combinations of poly-N-vinylcarbazole and trinitrofluorenone; and (4) layers using amorphous silicon.

Currently, organic photoreceptors using an organic photosensitive material are widely used because of satisfying such requisites as mentioned above and having the following advantages over the other photoreceptors:

(1) manufacturing costs are relatively low;

(2) having good designing flexibility (i.e., it is easy to design a photoreceptor having a desired property); and (3) hardly causing environmental pollution.

As for the organic photoreceptors, the following photosensitive layers are known:

(1) a photosensitive layer including a photoconductive resin such as polyvinyl carbazole (PVK) or the like material;

(2) a charge transfer photosensitive layer including a charge transfer complex such as a combination of polyvinyl carbazole (PVK) and 2,4,7-trinitrofluorenone (TNF) or the like material;

(3) a photosensitive layer in which a pigment, such as phthalocyanine or the like, is dispersed in a binder resin; and (4) a functionally-separated photosensitive layer including a charge generation material (hereinafter a CGM) and a charge transport material (hereinafter a CTM).

Among these organic photoreceptors, the photoreceptors having a functionally-separated photosensitive layer especially attract attention now.

The mechanism of forming an electrostatic latent image in the functionally-separated photosensitive layer having a charge generation layer (hereinafter a CGL) and a charge transport layer (hereinafter a CTL) formed on the CGL is as follows:

(1) when the photosensitive layer is exposed to light after being charged, light passes through the light-transmissive CTL and then reaches the CGL;

(2) the CGM included in the CGL absorbs the light and generates a charge carrier such as an electron and a positive hole;

(3) the charge carrier is injected to the CTL and transported through the CTL due to the electric field formed by the charge on the photosensitive layer;

(4) the charge carrier finally reaches the surface of the photosensitive layer and neutralizes the charge thereon, resulting in formation of an electrostatic latent image.

For such functionally-separated photoreceptors, a combination of a CTM mainly absorbing ultraviolet light and a CGM mainly absorbing visible light is effective and is typically used. Thus, functionally-separated photoreceptors satisfying the requisites as mentioned above can be prepared.

Currently, needs such as high speed recording and downsizing are growing for electrophotographic image forming apparatus. Therefore, an increasing need exists for durable photoreceptors having high reliability, which can produce good images even when repeatedly used for a long period of time while having the above-mentioned requisites.

Photoreceptors used for electrophotography receive various mechanical and chemical stresses. When a photoreceptor is abraded due to these stresses and its photosensitive layer is thinned, undesired images are produced.

In attempting to solve this abrasion problem, a technique in which a filler is included in a photoreceptor, and a technique in which a filler is dispersed in a surface of a photosensitive layer have been disclosed in Japanese Laid-Open Patent Publications Nos. (hereinafter JOPs) 1-205171, 7-333881, 8-15887, 8-123053 and 8-146641.

The durability, the ability to produce high quality images, and the stability of a photoreceptor including a filler depend on the dispersing condition of the filler in the photoreceptor.

When the filler is unevenly dispersed or large aggregations thereof exist in a layer (such as a photosensitive layer and a protective layer), the transparency of the layer decreases and irradiated light is scattered by such filler. As a result, a charge is unevenly generated and thereby the resultant image quality decreases. In addition, when a charge generated in the photosensitive layer is transported to the surface of the photoreceptor, the filler interferes with the charge transportation. As a result, the surface of the photoreceptor has an uneven potential and thereby the resultant image quality decreases. Further, there are problems such that cleanability of the photoreceptor deteriorates and that the cleaning blade becomes chipped, when large aggregations of the filler exist on the surface of the photoreceptor.

These problems can be solved by preparing a layer coating liquid in which a filler is well dispersed and aggregations thereof hardly exist. Such a layer coating liquid also needs to have high dispersion stability of the filler. When the dispersion stability of the filler is poor, the filler tends to precipitate at a time not only the layer coating liquid is preserved for a long period of time but also subjected to the preparation of the resultant layer. Such a layer coating liquid cannot stably prepare a photoreceptor.

In attempting to improve the dispersibility (i.e., dispersion and aggregation state) of a filler in a layer and the dispersion stability of a filler in a layer coating liquid, a technique in which a dispersing agent is added to a layer coating liquid have been disclosed in JOPs 2003-149849 and 2002-268257.

The polar surface of the filler is modified with the dispersing agent disclosed therein. The modified filler has better affinity for a solvent or a resin in the layer coating liquid, and thereby the dispersibility and dispersion stability of the filler in the layer coating liquid improve. It is described therein that the layer coating liquid including the dispersing agent can prepare a photoreceptor in which the filler is well dispersed in the layer, which has good abrasion resistance and is capable of producing images having good properties.

JOP 2006-63341 discloses an inorganic material surface-grafted with a charge transport moiety. It is disclosed therein that an imaging member including such a surface-grafted inorganic material as a filler has good abrasion resistance. The charge transport moiety is grafted to the surface of the inorganic material via a linking group or an anchoring group. It seems that there is a difficulty in applying this method to a variety of materials.

As mentioned above, by adding a filler to the outermost layer of a photoreceptor, durability of the photoreceptor increases. However, mechanical durability thereof is yet lower than that of a photoreceptor using an amorphous silicon. Since the needs such as high speed recording and downsizing may grow much more in the future, the need for a much more durable organic photoreceptor is increased.

SUMMARY OF THE INVENTION

Accordingly, an object of the present invention is to provide an electrophotographic photoreceptor which has good mechanical durability and stable electrophotographic properties such that images having good image qualities can be stably produced even when the photoreceptor is repeatedly used for a long period of time.

Another object of the present invention is to provide an image forming apparatus and a process cartridge by which images having good image qualities can be stably produced for a long period of time without frequently changing the photoreceptor.

These and other objects of the present invention, either individually or in combinations thereof, as hereinafter will become more readily apparent can be attained by an electrophotographic photoreceptor, comprising:

an electroconductive substrate; and a photosensitive layer located overlying the electroconductive substrate, wherein an outermost layer of the electrophotographic photoreceptor comprises:

a resin comprising a graft copolymer in which a monomer having a polar group is graft polymerized to a polycarbonate resin or a polyarylate resin; and a filler;

and an image forming apparatus and a process cartridge using the electrophotographic photoreceptor.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Generally, the present invention provides an electrophotographic photoreceptor including an electroconductive substrate and a photosensitive layer located overlying the electroconductive substrate, wherein the outermost layer of the electrophotographic photoreceptor comprises a resin comprising a graft copolymer in which a monomer having a polar group is graft polymerized to a polycarbonate resin or a polyarylate resin, and a filler.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

The image forming apparatus of the present invention using such a photoreceptor has good mechanical durability and electrophotographic properties and can produce images having good image qualities.

At first, the abrasion mechanism of a photoreceptor including a filler will be explained in detail. In electrophotography, a photoreceptor receives a mechanical stress in the cleaning process. In the cleaning process, a cleaning blade or a cleaning brush contacts the photoreceptor to remove remaining toner particles. Thereby, the photoreceptor is gradually abraded from a portion in which mechanical strength is low. When the photoreceptor is a photoreceptor including a resin and a filler, the resin portion is selectively abraded.

Figure 1A:
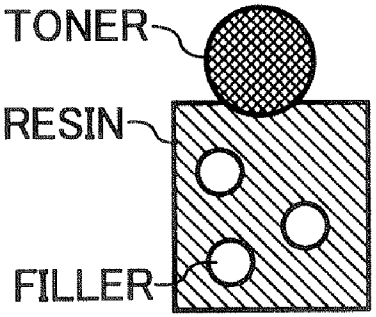
FIGS. 1A to 1C are schematic views for explaining how a photoreceptor including a filler is abraded.
Figure 1B:
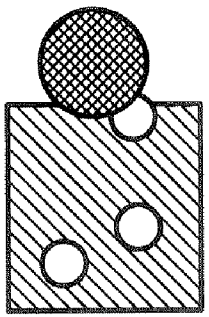
Figure 1C:
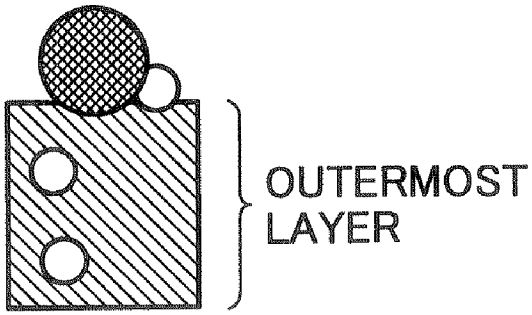

FIGS. 1A to 1C are schematic views for explaining how a photoreceptor including a filler is abraded. In FIG. 1A, since the filler is not present at the surface of the photoreceptor, the resin portion is abraded. In FIG. 1B, the resin portion surrounding the filler is abraded while the filler, which has a higher hardness than the resin, is not abraded. In this case, the abrasion rate of the resin portion is small due to the effect of the steric hindrance of the filler. In FIG. 1C, the filler is projected from the surface of the photoreceptor. In this case, the resin portion surrounding the filler is gradually abraded and thereby the contact area between the resin and the filler gradually decreases. As a result, the adherence between the resin and the filler decreases, and thereby the filler releases from the surface of the photoreceptor. Thus, the outermost layer (e.g., a photosensitive layer, a protective layer) of a photoreceptor is abraded.

The amount of abrasion depends on the mechanical strength of a resin, and the mechanical strength, the added amount, and the particle diameter of a filler. In FIG. 1C, the adherence between the filler and the resin largely influences the amount of abrasion. By increasing the affinity between the filler and the resin, abrasion resistance of the photoreceptor increases. When the affinity between the filler and the resin increases, dispersibility and dispersing stability of the filler in a coating liquid also increases, resulting in formation of a photosensitive layer or a protective layer in which the filler is well dispersed.

As a result of the present studies, it becomes clear that a resin to which a monomer having a polar group which has high affinity for a filler is graft polymerized, has high affinity for the filler. In particular, polycarbonate and polyarylate resins which have good mechanical and chemical durability are preferably used as the resin.

Such a graft copolymer of a polycarbonate resin or a polyarylate resin will be explained in detail.

Preferred resins include, but are not limited to, vinyl polymers (e.g., polymethyl methacrylate, polystyrene, polyolefin) and copolymers thereof, thermoplastic resins (e.g., polycarbonate resins, polyarylate resins, polyester resins, phenoxy resins, epoxy resins, silicone resins), and thermosetting resins. Among these, polycarbonate resins, polyarylate resins, and copolymers having these structures have been preferably used because of having good manufacturability, mechanical strength, and abrasion resistance, as disclosed in JOPs 59-071057, 10-288845, and 2006-53262. The present inventors have found that a polycarbonate resin or a polyarylate resin, which is subjected to a graft polymerization in which a monomer having high affinity for a filler is graft polymerized thereto, has high affinity for the filler, resulting in increasing mechanical strength of the resultant photoreceptor.

In the graft polymerization, a hydrogen atom is abstracted from a polycarbonate resin, a polyarylate resin, or a copolymer having these structures, by using an oxygen radical, electron irradiation, or light irradiation to an aromatic ketone. Among these, a method using oxygen radical is suitable for preparing the photoreceptor of the present invention. The oxygen radical is produced by decomposition of a peroxide such as a diacyl peroxide, a peroxy ester, and a hydroperoxide.

As the monomer which is graft polymerized to the resin, a vinyl monomer having a polar group is preferably used. Specific examples of such monomers include, but are not limited to, acrylic acid and esters thereof, methacrylic acid and esters thereof, itaconic acid and esters thereof, itaconic anhydride, acrylonitrile, acrylamide, vinylpyridine, vinylpyrrolidone, vinylpyrazine, vinylimidazole, vinyl benzoic acid and esters thereof, and vinylbenzyl chloride. These can be polymerized alone or copolymerized in combination. A monomer having no polar group such as styrene and vinyltoluene may also be copolymerized in combination with above monomers.

A hydrogen atom is abstracted from a phenyl group, a substitutent group of a phenyl group, and/or an alkyl group included in the main chain of the resin. Among these, an alkyl group, which has high reactivity, is preferably included in the resin.

The above-mentioned polycarbonate resins, polyarylate resins, and copolymers having these structures preferably have units of bisphenol compounds having the following formula (1) optionally having an alkyl group:

$$HO—X—OH \quad (1)$$

wherein X represents a divalent group having the following formulae (2) or (3):

(2)

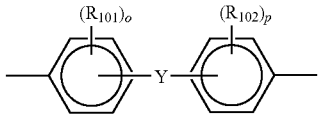

(3)

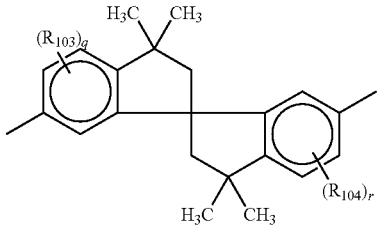

wherein each of $R_{101}$, $R_{102}$, $R_{103}$, and $R_{104}$ independently represents a halogen atom, a substituted or unsubstituted alkyl group having 1 to 6 carbon atoms, or a substituted or unsubstituted aryl group; each of o and p independently represents an integer of 0 to 4; each of q and r independently represents an integer of 0 to 3; Y represents a single bond, a linear alkylene group having 2 to 4 carbon atoms, —O—, —S—, or the following functional groups having the following formulae (4) to (7):

(4)

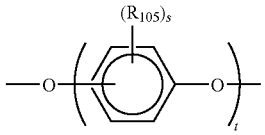

wherein $R_{105}$ represents a halogen atom, a substituted or unsubstituted alkyl group or alkoxy group having 1 to 6 carbon atoms, or a substituted or unsubstituted aryl group; s represents an integer of 0 to 4 and t represents a positive integer;

(5)

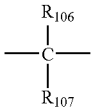

wherein each of $R_{106}$ and $R_{107}$ independently represents a hydrogen atom, a halogen atom, a substituted or unsubstituted alkyl group or alkoxy group having 1 to 6 carbon atoms, or a substituted or unsubstituted aryl group, wherein $R_{106}$ and $R_{107}$ optionally share bond connectivity to form a carbon ring having 5 to 12 carbon atoms;

(6)

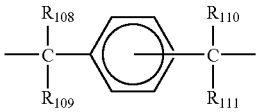

wherein each of $R_{108}$, $R_{109}$, $R_{110}$, and $R_{111}$ independently represents a hydrogen atom, a halogen atom, a substituted or unsubstituted alkyl group or alkoxy group having 1 to 6 carbon atoms, or a substituted or unsubstituted aryl group; and (7)

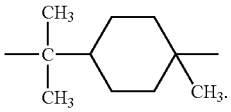

Specific examples of the halogen atoms represented by $R_{101}$ to $R_{111}$ include, but are not limited to, fluorine atom, chlorine atom, bromine atom, and iodine atom.

Specific examples of the substituted or unsubstituted alkyl groups having 1 to 6 carbon atoms represented by $R_{101}$ to $R_{111}$ include, but are not limited to, straight-chain, branched-chain, and cyclic alkyl groups which may have a substitutent group (e.g., fluorine atom, cyano group, phenyl group, a phenyl group substituted with a halogen atom or a straight-chain, branched-chain, or cyclic alkyl group having 1 to 6 atoms), such as methyl group, ethyl group, n-propyl group, i-propyl group, t-butyl group, s-butyl group, n-butyl group, i-butyl group, trifluoromethyl group, 2-cyanoethyl group, benzyl group, 4-chlorobenzyl group, 4-methylbenzyl group, cyclopentyl group, and cyclohexyl group.

Specific examples of the substituted or unsubstituted aryl groups represented by $R_{101}$ to $R_{111}$ include, but are not limited to, phenyl group and naphthyl group which may have a substitutent group (e.g., a halogen atom such as fluorine atom, chlorine atom, bromine atom, and iodine atom; a substituted or unsubstituted alkyl group having 1 to 6 carbon atoms).

Specific examples of the linear alkylene group having 2 to 4 carbon atoms represented by Y include, but are not limited to, ethylene group, propylene group, and butylene group.

Specific examples of the substituted or unsubstituted alkoxy group having 1 to 6 carbon atoms represented by $R_{105}$ to $R_{111}$ include, but are not limited to, alkoxy groups having the above-mentioned substituted or unsubstituted alkyl groups having 1 to 6 carbon atoms, such as methoxy group, ethoxy group, n-propoxy group, i-propoxy group, n-butoxy group, i-butoxy group, s-butoxy group, t-butoxy group, 2-hydroxyethoxy group, 2-cyanoethoxy group, benzyloxy group, 4-methylbenzyloxy group, and trifluoromethoxy group.

Specific examples of the carbon ring having 5 to 12 carbon atoms formed by connecting $R_{106}$ and $R_{107}$ include, but are not limited to, cyclopentane, cyclohexane, cycloheptane, cyclooctane, and cyclooctadecane.

Specific examples of the diols represented by the formula (1) include, but are not limited to, bis(4-hydroxyphenyl)methane, bis(2-methyl-4-hydroxyphenyl)methane, bis(3-methyl-4-hydroxyphenyl)methane, 1,1-bis(4-hydroxyphenyl)ethane, 1,2-bis(4-hydroxyphenyl)ethane, bis(4-hydroxyphenyl)phenylmethane, 1,1-bis(4-hydroxyphenyl)-1-phenylethane, 1,3-bis(4-hydroxyphenyl)-1,1-dimethylpropane, 2,2-bis(4-hydroxyphenyl)propane, 2-(4-hydroxyphenyl)-2-(3-hydroxyphenyl)propane, 1,1-bis(4-hydroxyphenyl)-2-methylpropane, 2,2-bis(4-hydroxyphenyl)butane, 1,1-bis(4-hydroxyphenyl)-3-methylbutane, 2,2-bis(4-hydroxyphenyl)pentane, 2,2-bis(4-hydroxyphenyl)-4-methylpentane, 2,2-bis(4-hydroxyphenyl)hexane, 4,4-bis(4-hydroxyphenyl)heptane, 2,2-bis(4-hydroxyphenyl)nonane, bis(3,5-dimethyl-4-hydroxyphenyl)methane, 2,2-bis(3-methyl-4-hydroxyphenyl)propane, 2,2-bis(3-isopropyl-4-hydroxyphenyl)propane, 2,2-bis(3-sec-butyl-4-hydroxyphenyl)propane, 2,2-bis(3-tert-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-phenyl-4-hydroxyphenyl)propane, 2,2-bis(3,5-dimethyl-4-hydroxyphenyl)propane, 2,2-bis(3-chloro-4-hydroxyphenyl)propane, 2,2-bis(3,5-dichloro-4-hydroxyphenyl)propane, 2,2-bis(3-bromo-4-hydroxyphenyl)propane, 2,2-bis(3,5-dibromo-4-hydroxyphenyl)propane, 1,1-bis(4-hydroxyphenyl)cyclopentane, 1,1-bis(4-hydroxyphenyl)cyclohexane, 1,1-bis(3-methyl-4-hydroxyphenyl)cyclohexane, 1,1-bis(3,5-dimethyl-4-hydroxyphenyl)cyclohexane, 1,1-bis(3,5-dichloro-4-hydroxyphenyl)cyclohexane, 1,1-bis(4-hydroxyphenyl)-3,3,5-trimethylcyclohexane, 1,1-bis(4-hydroxyphenyl)cycloheptane, 2,2-bis(4-hydroxyphenyl)norbornane, 2,2-bis(4-hydroxyphenyl)adamantane, 3,3'-dimethyl-4,4'-dihydroxydiphenylsulfide, 3,3',5,5'-tetramethyl-4,4'-dihydroxydiphenylsulfide, 3,3,3',3'-tetramethyl-6,6'-dihydroxyspiro(bis)indane, and 3,3',4,4'-tetrahydro-4,4,4',4'-tetramethyl-2,2'-spirobi(2H-1-benzopyran)-7,7'-diol.

Next, the filler for use in the present invention will be explained in detail.

The outermost layer of the photoreceptor includes a filler such as organic fillers or inorganic fillers to improve the abrasion resistance of the photoreceptor. Specific examples of the organic fillers include, but are not limited to, powders of fluorine-containing resins such as polytetrafluoroethylene, silicone resin powders, and carbon powders. Specific examples of the inorganic fillers include, but are not limited to, powders of metals such as copper, tin, aluminum, and indium; silica; metal oxides such as tin oxide, zinc oxide, titanium oxide, indium oxide, antimony oxide, bismuth oxide, tin oxide doped with antimony, and indium oxide doped with tin; and potassium titanate. Among these fillers, inorganic fillers are preferably used in view of hardness. In particular, silica and metal oxides are preferably used. Among the metal oxides, aluminum oxide, and titanium oxide are preferably used.

The average primary particle diameter of the filler included in the outermost layer is preferably from 0.01 to 0.5 μm to improve the light-transmittance and abrasion resistance of the outermost layer. When the average primary particle diameter of the filler used is too small, the abrasion resistance of the outermost layer and the dispersibility of the filler in a coating liquid deteriorate. To the contrary, when the average primary particle diameter of the filler used is too large, the amount of the participated filler increases in a coating liquid and a toner filming problem such that a film of the toner used is formed on the outermost layer tends to occur.

The more the concentration of the filler included in the outermost layer, the better the abrasion resistance of the outermost layer. However, when the concentration is too high, adverse affects are produced such that residual potential of the resultant photoreceptor increases and transmittance of the outermost layer against the light used for writing images deteriorates. Therefore the concentration is preferably not greater than 80% by weight, and more preferably not greater than 50% by weight, based on total solid components of the outermost layer.

The lower limit of the filler concentration should be determined depending on the abrasion resistance of the filler used. In general, the filler content is preferably not less than 5% by weight.

The fillers are preferably treated with at least one surface treating agent to improve the dispersibility thereof. Deterioration of dispersibility of a filler included in the outermost layer not only increases residual potential but also decreases transparency of the outermost layer, generates coating deficiencies, and deteriorates abrasion resistance of the outermost layer, and thereby a large problem occurs such that a photoreceptor having good durability and capable of producing good images cannot be provided. Suitable surface treating agents include known surface treating agents, but surface treating agents which can maintain the insulating properties of the filler to be used in the outermost layer are preferable. Specific examples of such surface treating agents include, but are not limited to, titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and mixtures thereof. These are preferable because of being able to impart good dispersibility to fillers and to prevent the blurred image problem. When a filler treated with a silane coupling agent is used, the blurred image problem tends to be caused. However, when used in combination with the surface treating agents mentioned above, the problem can be avoided. The content of a surface treating agent in a coated filler, which depends on the average primary particle diameter of the filler, is from 3 to 30% by weight, and more preferably 5 to 20% by weight. When the content is too low, good dispersibility cannot be obtained. To the contrary, when the content is too high, residual potential seriously increases. These fillers can be used alone or in combination.

Next, the photoreceptor of the present invention will be explained referring to drawings.

Figure 2:
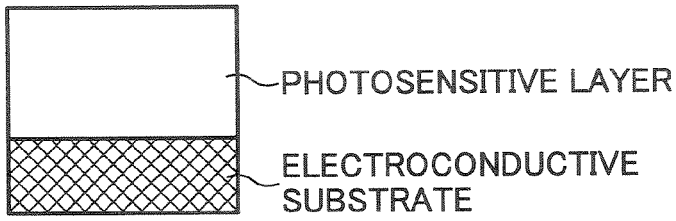
FIGS. 2 to 5 are schematic cross-sectional views of embodiments of the photoreceptor of the present invention.

FIG. 2 is a schematic cross sectional view illustrating an embodiment of the photoreceptor of the present invention. In the photoreceptor, a photosensitive layer including a filler is formed on an electroconductive substrate.

Figure 3:
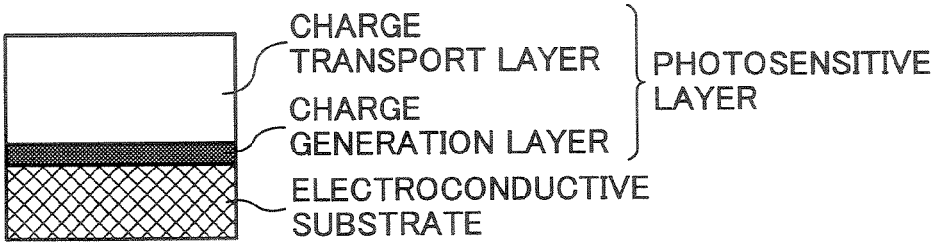

FIG. 3 is a schematic cross sectional view illustrating another embodiment of the photoreceptor of the present invention. In the photoreceptor, a CGL and a CTL including a filler are overlaid on an electroconductive substrate.

Figure 4:
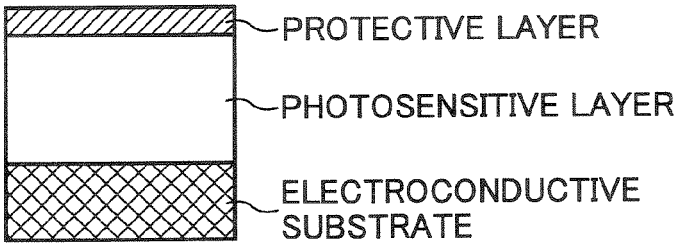

FIG. 4 is a schematic cross sectional view illustrating yet another embodiment of the photoreceptor of the present invention. In the photoreceptor, a photosensitive layer and a protective layer including a filler are overlaid on an electroconductive substrate.

Figure 5:
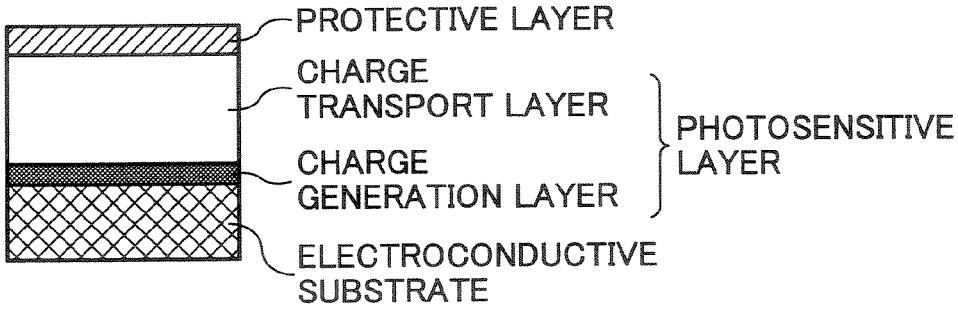

FIG. 5 is a schematic cross sectional view illustrating yet another embodiment of the photoreceptor of the present invention. In the photoreceptor, a CGL, a CTL, and a protective layer including a filler are overlaid on an electroconductive substrate.

The structure of the photoreceptor of the present invention is not limited to the structures illustrated in FIGS. 2 to 5 as long as at least one of the photosensitive layer, the charge transport layer, or the protective layer includes a filler. For example, an undercoat layer may be formed on the electroconductive substrate so as to prevent the occurrence of moiré and charge injection from the electroconductive substrate to the photosensitive layer.

Next, the continuous structure of the photosensitive layer and the protective layer illustrated in FIGS. 4 and 5 will be explained.

Figure 6A:
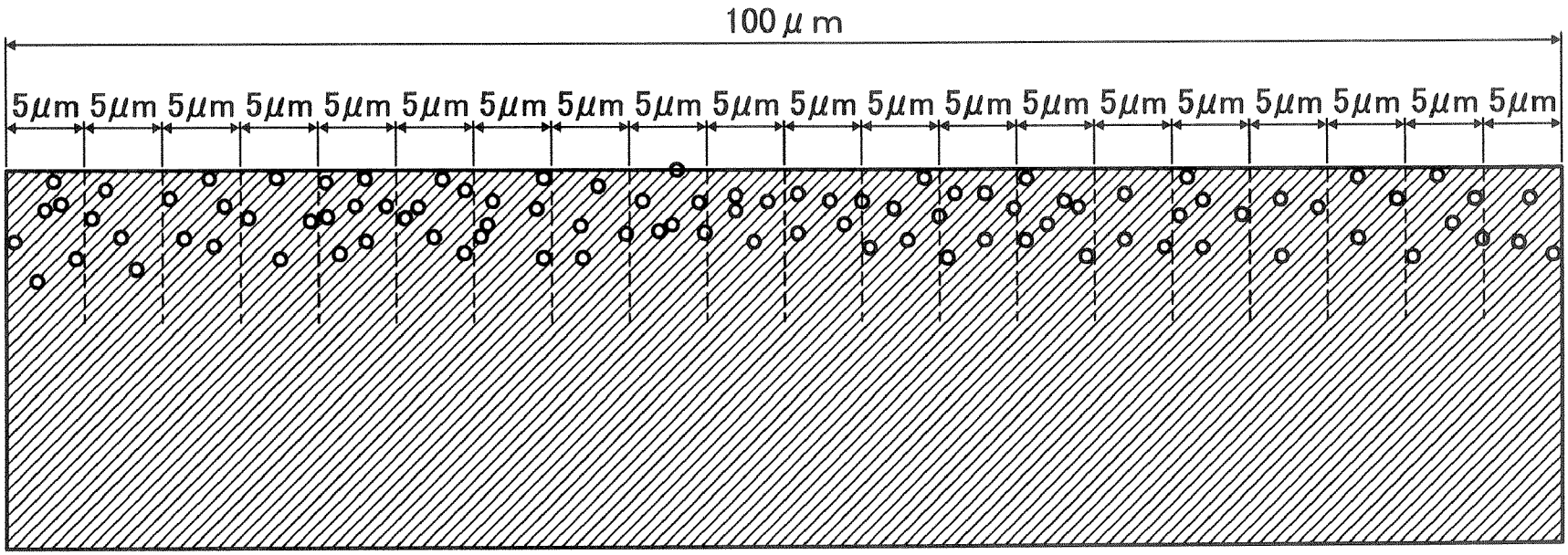
FIG. 6A is a schematic cross-sectional view illustrating the photoreceptor of the present invention for explaining how to determine the average maximum thickness D of the protective layer.
Figure 6B:
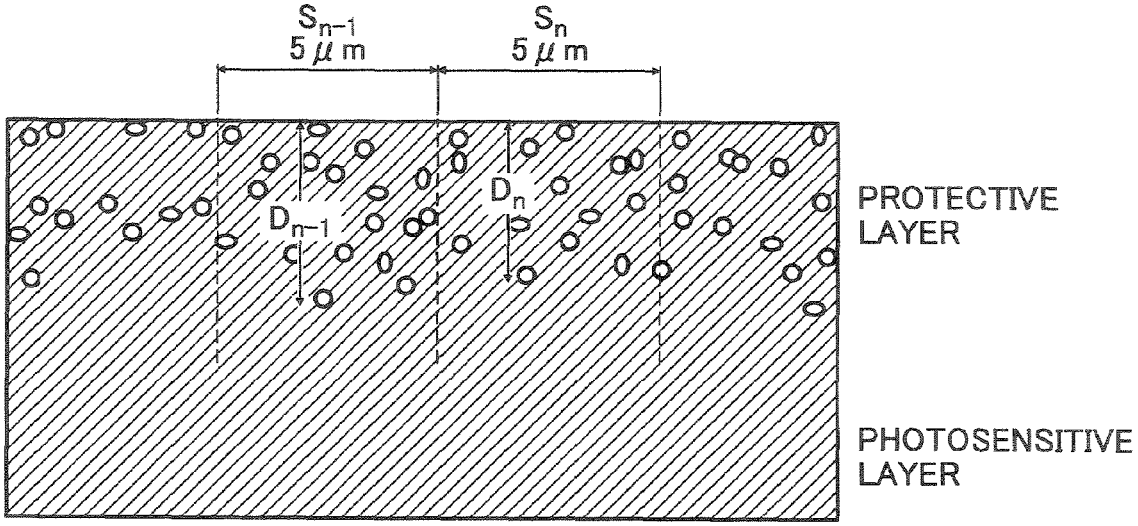
FIG. 6B is a schematic cross section of the protective layer of the photoreceptor of the present invention in which a protective layer and a photosensitive layer have a continuous structure and for explaining how to determine the maximum thicknesses Dn of the protective layer and its standard deviation $\sigma$.

The continuous structure which the photosensitive layer and the protective layer should have in the present invention means such structures as shown in FIGS. 6A and 6B. Namely, in the photoreceptor of the present invention, the photosensitive layer and the protective layer do not have a clear boundary (interface) except that the protective layer includes a filler and the photosensitive layer does not include a filler. In other words, the constituents of the photosensitive layer, such as a resin and a photosensitive material (in particular a resin), and the resin in the protective layer do not have a clear boundary (interface). In order to form such a continuous structure, both the resin included in the protective layer and at least one of the constituents (particularly the resin) included in the photosensitive layer need to dissolve in a solvent. When a protective layer coating liquid including such a solvent is coated on a photosensitive layer, one or more of the constituents (the resin) present on the surface of the photosensitive layer are dissolved by the solvent when the coating liquid contacts the surface of the photosensitive layer. Thereby, the resin in the protective layer coating liquid mixes with the constituents present on the surface of the photosensitive layer, resulting in formation of the continuous structure.

Figure 6C:
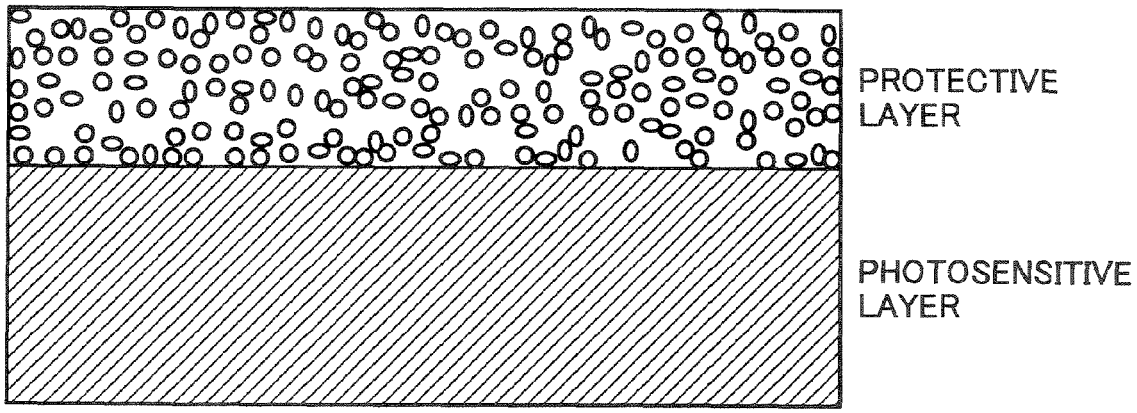
FIG. 6C is a schematic cross-sectional view of a comparative photoreceptor in which a protective layer and a photosensitive layer have a discontinuous structure.

To the contrary, the discontinuous structure of the photosensitive layer and protective layer means such a structure as shown in FIG. 6C. Namely, the photosensitive layer and the protective layer have a clear boundary. Such a discontinuous structure can be formed by coating a protective layer coating liquid including a solvent not dissolving the constituents in the photosensitive layer. When such a coating liquid is coated on the photosensitive layer, a clear boundary can be formed because the photosensitive layer particularly the resin in the photosensitive layer) is not dissolved by the solvent.

Next, the maximum thickness Dn, the average maximum thickness D, and the standard deviation σ of the maximum thickness Dn will be explained.

The maximum thickness Dn and the average maximum thickness D of the photoreceptor of the present invention can be determined by observing the cross section of the photoreceptor. The cross section of a photoreceptor can be prepared by cutting the photoreceptor in the thickness direction perpendicular to the surface of the photoreceptor using a microtome, etc. The thus prepared cross section is observed by a scanning electron microscope (SEM) of 2,000 power magnification and photographed. As shown in FIG. 6A, an area of 100 μm length of the photographed surface portion of the photoreceptor is equally divided into 20 segments (i.e., the width of each segment is 5 μm). The maximum thickness Dn of each segment is determined as the distance between the surface of the segment and the filler particle which is located at the lowest position in the segment. Namely, as can be understood from FIG. 6B, in the segments Sn−1 and Sn, the maximum thickness of the protective layer is Dn−1 and Dn, respectively. The average maximum thickness D of the protective layer is defined as the arithmetical average of the thus determined 20 maximum thicknesses. In addition, the standard deviation σ is defined as the standard deviation of the 20 maximum thicknesses.

Below, the reason why the average maximum thickness and the standard deviation should be determined while dividing the surface portion of 100 μm wide into 20 segments of 5 μm wide will be explained.

The average particle diameter of the toner currently used for electrophotographic image forming apparatus is from about 5 to 10 μm. As a result of an image forming experiment using such a toner, it is found that an image consisting of solid images having a width of about 100 μm and having different image densities is observed as an uneven density image.

In addition, in an image forming apparatus in which an electrostatic latent dot image is formed by switching on/off light, when the average diameter of the light beam (i.e., a half width, provided that the illuminance of the light beam accords with the Gaussian curve) is 100 μm, it is found that an image consisting of solid images having a diameter of 100 μm and having different image densities is observed as an undesired density image. In addition, when the light beam has an average diameter less than 100 μm, seriously uneven density images are produced.

The present inventors discover that this variation in image density of the dot images correlates with the standard deviation σ of the maximum thickness Dn. Namely, it is found that when a toner having an average particle diameter of from 5 to 10 μm is used, the correlation of the standard deviation σ of the maximum thicknesses Dn in 20 segments of 5 μm width with the degree of the variation in image density of the dot images is very high. Therefore, when the conditions of the surface portion of the photoreceptor are properly controlled such that the protective layer has the above-mentioned specific maximum thickness and standard deviation, occurrence of uneven images can be prevented.

The surface portion is sampled from the image forming portion of the photoreceptor and the average maximum thickness D and standard deviation σ thereof are measured by the method mentioned above. The standard deviation σ is not greater than one fifth (⅕) of the average maximum thickness D of the protective layer, and preferably not greater than ⅐ (i.e., D/7).

The maximum thickness Dn of the protective layer preferably ranges from not less than 2D/3 to not greater than 4D/3.

The resin in the photosensitive layer mentioned above means the resin included in the top layer of the photosensitive layer, which top layer contacts the protective layer, when the photosensitive layer has a multi-layer structure.

Next, the influence of the structure of the interfacial portion between the protective layer and the photosensitive layer on the photoreceptor properties will be explained. At first, the influence on the mechanical durability of the photoreceptor will be explained.

When the solvent included in the protective layer coating liquid does not dissolve the photosensitive layer (in particular the resin in the photosensitive layer), the protective layer and the photosensitive layer have a discontinuous structure as shown in FIG. 6C. When a photoreceptor having such a structure is repeatedly used for a long period of time, the protective layer peels from the photosensitive layer from the edge portions of the photoreceptor because the adhesion of the protective layer to the photosensitive layer is weak.

To the contrary, when the solvent in the protective layer coating liquid includes a solvent that can also dissolve the photosensitive layer (in particular the resin in the photosensitive layer), the protective layer and the photosensitive layer have a continuous structure as shown in FIGS. 6A and 6B. When a photoreceptor having such a structure is repeatedly used for a long period of time, the peeling problem can be avoided because the adhesion of the protective layer to the photosensitive layer is strong. This is because the lower portion of the protective layer is mixed with the upper portion of the photosensitive layer.

Next, the influence of the structure on the electrophotographic properties of the photoreceptor and image qualities of the images produced by the photoreceptor will be explained.

In the photoreceptor in which the protective layer and the photosensitive layer have a discontinuous structure, the image qualities of initial images are good. However, in this case the CTM in the CTL tends to crystallize. When the CTM crystallizes, the resultant photoreceptor produces undesired images even in the initial stage. In addition, when such a photoreceptor is repeatedly used, charge injection from the photosensitive layer to the protective layer is obstructed, resulting in increase of the lighted-area potential of the photoreceptor, and thereby the image qualities are deteriorated (e.g., the image density decreases and background fouling occurs).

In contrast, when the photosensitive layer and the protective layer have a continuous structure, the movement of the charges from the photosensitive layer to the protective layer is not obstructed, and thereby the increase of the lighted-area potential can be prevented even if the photoreceptor is repeatedly used. However, when the protective layer is excessively mixed with the photosensitive layer, the image qualities also deteriorate.

On the other hand, when a photoreceptor has a property such that a very uniform potential is formed on the entire surface thereof when the photoreceptor is charged, the resultant solid image has an edge effect as mentioned above. Namely, at an edge portion of such a very uniform electrostatic latent solid image, electric flux lines erect, and thereby a larger amount of toner particles are adhered to the edge portion than in the other portions. Therefore, problems occur such that the line of the edge portion widens and toner scattering occurs around the solid image.

The present inventors have discovered that such problems can be prevented by forming microscopically uneven potential on the surface of the photoreceptor. In order to form microscopically uneven potential on the surface of the photoreceptor, the protective layer and photosensitive layer preferably have a proper continuous structure. Namely, by properly dissolving the photosensitive layer (particularly the resin therein) using the solvent included in the protective layer coating liquid, the resultant protective layer and photosensitive layer have a proper continuous structure, i.e., the boundary area of the protective layer and photosensitive layer becomes microscopically uneven, and thereby microscopically uneven potential can be formed on the surface of the resultant photoreceptor. Thus, problems such as widening of the line of the edge portion and toner scattering around the solid image can be prevented.

As mentioned above, the photoreceptor in which the protective layer and photosensitive layer have a continuous structure has properties different from those of the photoreceptor in which the protective layer and photosensitive layer have a discontinuous structure. The present inventors have discovered that the object of the present invention can be attained by a photoreceptor in which the protective layer and photosensitive layer have a continuous structure and in which the standard deviation σ of the maximum thickness is not greater than one fifth of the average maximum thickness D (i.e., D/5). Namely, a photoreceptor in which the protective layer and photosensitive layer have a continuous structure, such that the photosensitive layer and the protective layer are properly mixed with each other at the boundary portion, has good mechanical durability and electrophotographic properties and can produce images having good image qualities.

The degree of mixing of the photosensitive layer with the protective layer at their boundary portion can be represented by the standard deviation σ. When the mixing degree is large, the standard deviation of the maximum thickness becomes large. To the contrary, when the mixing degree is small, the standard deviation also becomes small.

Figure 7:
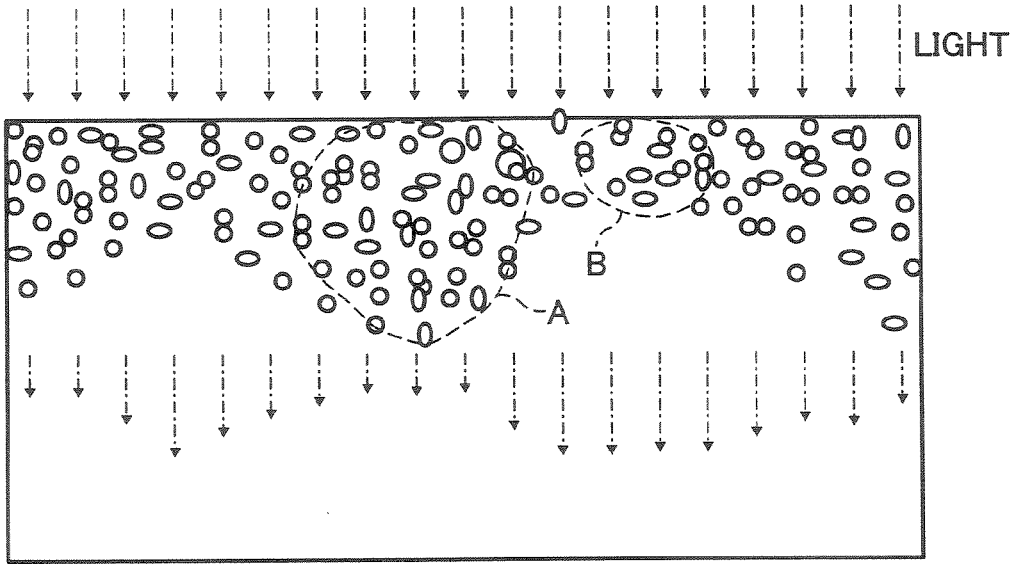
FIG. 7 is a schematic cross-sectional view for explaining how an uneven light quantity phenomenon occurs in a photoreceptor in which a protective layer and a photosensitive layer have a continuous structure.

As illustrated in FIG. 7, when light containing image information irradiates the surface of a photoreceptor, part of the incident light is scattered by the filler particles in the protective layer, resulting in a decrease of the light quantity. When a photoreceptor has a large standard deviation of the maximum thickness, this light scattering is unevenly performed. Namely, in FIG. 7, at a point A in which the maximum thickness is large, the quantity of transmitted light is relatively small compared to the light quantity at a point B in which the maximum thickness is small. Thus, light containing image information having uneven light quantity reaches the photosensitive layer, and thereby charges are also unevenly generated at the photosensitive layer.

Namely, when the standard deviation of the maximum thickness of the protective layer is large, the quantity of light reaching the photoreceptor becomes uneven and the quantity of generated charges also becomes uneven.

Figure 8A:
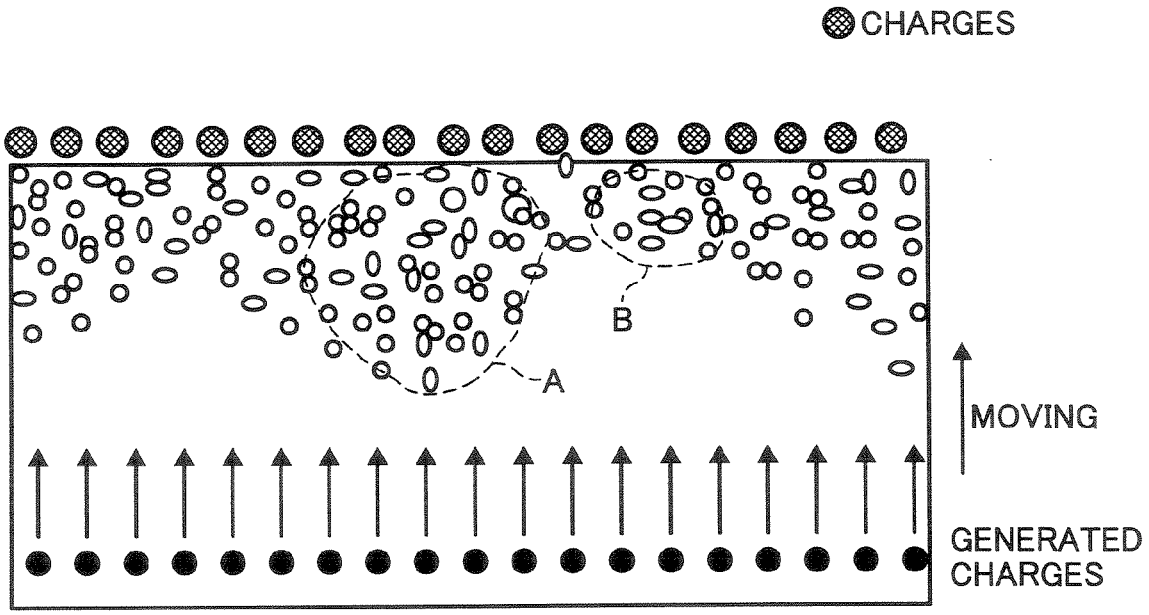
FIGS. 8A and 8B are schematic cross-sectional views for explaining how an uneven charge trapping phenomenon occurs in a photoreceptor in which a protective layer and a photosensitive layer have a continuous structure.
Figure 8B:
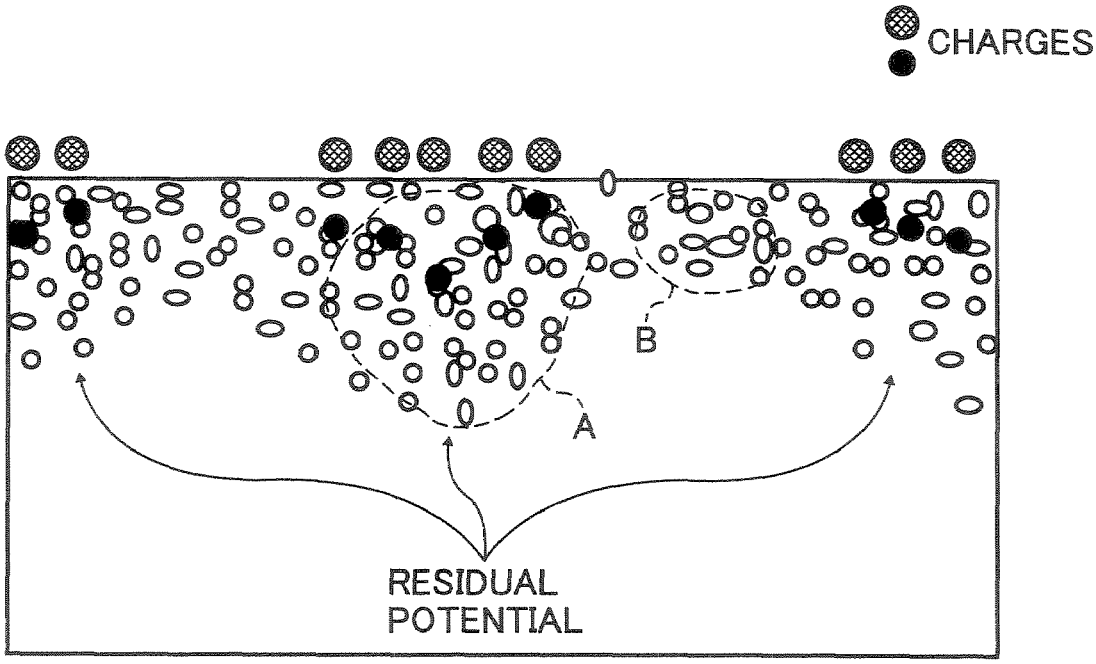

As illustrated in FIGS. 8A and 8B, the charges generated in the photosensitive layer move through the protective layer. The charges moving the protective layer are trapped by the filler particles, resulting in formation of residual potential. When the maximum thickness is large, the charges generated in the photosensitive layer and moving upwardly tend to be trapped by the protective layer. In contrast, when the maximum thickness is small, the charges generated in the photosensitive layer tend to be hardly trapped by the protective layer. Namely, when the standard deviation of the maximum thickness is large, charges are unevenly formed on the surface of the photoreceptor.

Thus, due to uneven light scattering and uneven charge trapping, charges are unevenly formed on the surface of the photoreceptor, resulting in formation of an uneven visual (i.e., toner) image.

Figure 9A:
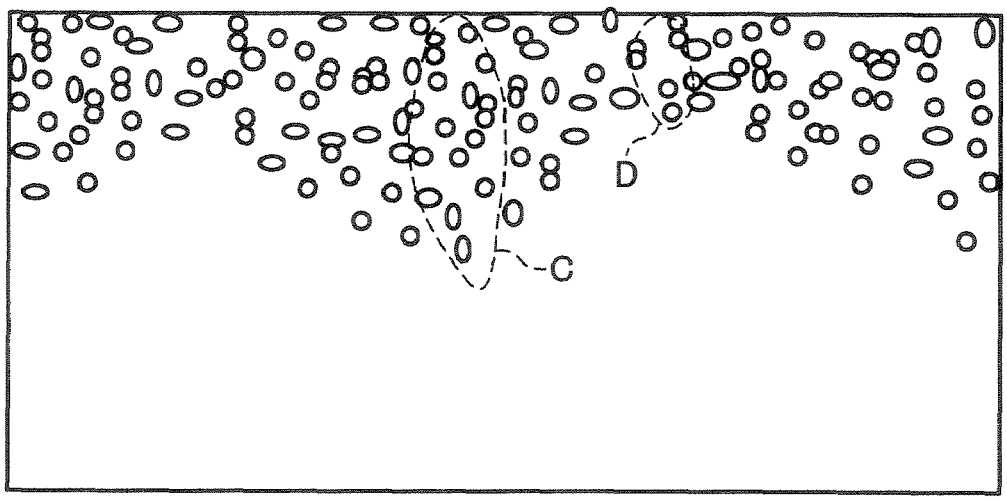
FIGS. 9A and 9B are schematic cross-sectional views for explaining how an uneven abrasion phenomenon occurs in a photoreceptor in which a protective layer and a photosensitive layer have a continuous structure.
Figure 9B:
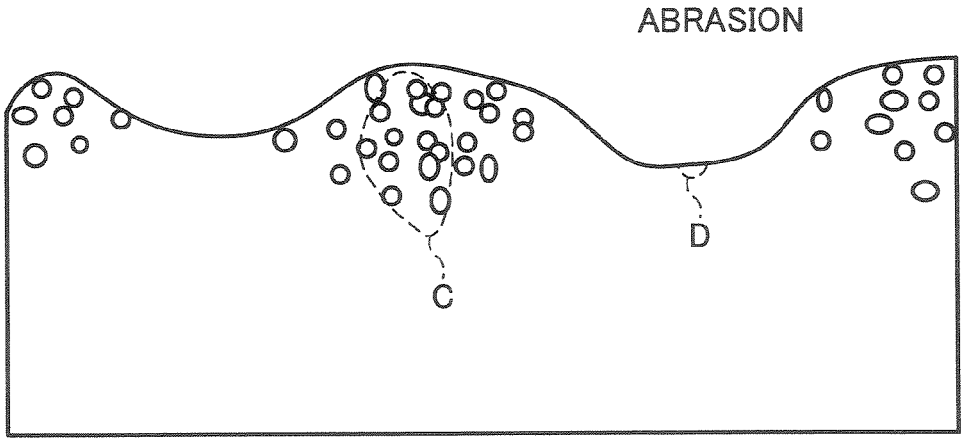

In addition, as illustrated in FIGS. 9A and 9B, at a portion C of a photoreceptor having a large maximum thickness, the abrasion speed of the protective layer is slow whereas at a portion D of the photoreceptor having a small maximum thickness, the abrasion speed is fast. Therefore, when the standard deviation is large, the abrasion of the protective layer becomes uneven. Thus, uneven density images are produced.

When the protective layer and photosensitive layer have a continuous structure and the standard deviation σ of the average maximum thickness D of the protective layer is not greater than one fifth of the average thickness D (i.e., D/5), the resultant photoreceptor has good properties. In addition, when the standard deviation is not greater than one seventh of the average maximum thickness D (i.e., D/7), the resultant photoreceptor has better properties.

It is preferable that the standard deviation is small. However, when the standard deviation is 0, the protective layer and photosensitive layer have a discontinuous structure and therefore it is not preferable.

Therefore it is preferable that the preparation conditions of the protective layer coating liquid and coating conditions of the coating liquid, environmental conditions during the coating operations, etc., should be properly controlled such that the following relationship is satisfied:

$$\sigma \leqq D/5,$$

and preferably, the following relationship is satisfied:

$$\sigma \leqq D/7.$$

Next, the layers of the photoreceptor of the present invention will be explained in detail.

Suitable materials for use as the electroconductive substrate include materials having a volume resistance not greater than $10^{10}$ Ω·cm. Specific examples of such materials include, but are not limited to, plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like, which have been disclosed, for example, in Japanese Patent Publication No. 52-36016, can also be used as the substrate.

Furthermore, substrates, in which a coating liquid including a binder resin and an electroconductive powder is coated on the supports mentioned above, can be used as the substrate. Specific examples of such an electroconductive powder include, but are not limited to, carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate.

Next, the photosensitive layer will be explained.

In the present invention, the photosensitive layer may have a single-layer structure or a multi-layer structure. The photosensitive layer having a charge generation layer (CGL) and a charge transport layer (CTL) will be explained at first.

The CGL includes a CGM as a main component. Suitable CGMs include known CGMs. Specific examples of such CGMs include, but are not limited to, azo pigments such as monoazo pigments, disazo pigments, and trisazo pigments; perylene pigments, perynone pigments, quinacridone pigments, quinone type condensed polycyclic compounds, squaric acid type dyes, phthalocyanine pigments, naphthalocyanine pigments, azulenium salt dyes, and the like pigments and dyes. These CGMs can be used alone or in combination.

Among these pigments and dyes, azo pigments and phthalocyanine pigments are preferably used. In particular, azo pigments having the following formula (8) and titanyl phthalocyanine having an X-ray diffraction spectrum in which a highest peak is observed at Bragg 2θ angle of 27.2°±0.2° when a specific X-ray of Cu—Kα having a wavelength of 1.541 Å irradiates the titanyl phthalocyanine pigment are preferably used.

(8)

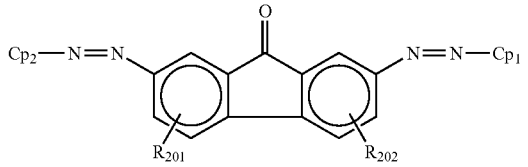

wherein each of $R_{201}$ and $R_{202}$ independently represents a hydrogen atom, a halogen atom, an alkyl group, an alkoxy group, or a cyano group; and each of $Cp_1$ and $Cp_2$ independently represents a residual group of a coupler, which has the following formula (9):

(9)

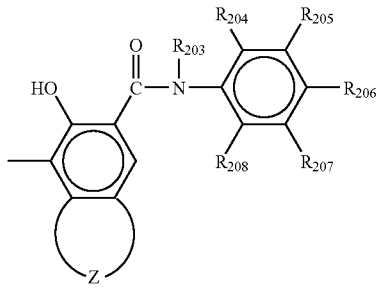

wherein $R_{203}$ represents a hydrogen atom, an alkyl group such as a methyl group and an ethyl group, or an aryl group such as a phenyl group; each of $R_{204}$, $R_{205}$, $R_{206}$, $R_{207}$ and $R_{208}$ independently represents a hydrogen atom, a nitro group, a cyano group, a halogen atom such as a fluorine atom, a chlorine atom, a bromine atom and an iodine atom, an alkyl group such as a trifluoromethyl group, a methyl group and an ethyl group, an alkoxy group such as a methoxy group and an ethoxy group, a dialkylamino group or a hydroxyl group; and Z represents an atomic group needed for constituting a substituted or unsubstituted aromatic carbon ring or a substituted or unsubstituted aromatic heterocyclic ring.

The CGL can be prepared by any suitable method, preferably, for example, by the following method:

(1) a CGM is mixed with a proper solvent optionally together with a binder resin;

(2) the mixture is dispersed using a ball mill, an attritor, a sand mill or a supersonic dispersing machine to prepare a coating liquid; and (3) the coating liquid is coated on an electroconductive substrate and then dried to form a CGL.

Suitable binder resins, which are optionally used for the CGL coating liquid, include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the CGL is preferably from 0 to 500 parts by weight, and more preferably from 10 to 300 parts by weight, per 100 parts by weight of the CGM included in the CGL.

Suitable solvents for use in the CGL coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The CGL coating liquid can be coated by a coating method such as dip coating, spray coating, bead coating, nozzle coating, spinner coating and ring coating.

The thickness of the CGL is preferably from 0.01 to 5 μm, and more preferably from 0.1 to 2 μm.

The CTL can be formed by any desired method, preferably, for example, by the following method:

(1) a CTM and a binder resin are dispersed or dissolved in a proper solvent to prepare a CTL coating liquid; and (2) the CTL coating liquid is coated on the CGL and dried to form a CTL.

The CTL may include additives such as plasticizers, leveling agents, antioxidants and the like, if desired.

CTMs are classified into positive-hole transport materials and electron transport materials.

Specific examples of the electron transport materials include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include, but are not limited to, known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These CTMs can be used alone or in combination. In addition, polymeric CTMs having both charge transport ability and a function as binder can also be used.

When the CTL is the outermost layer of the photoreceptor, at least a graft copolymer in which a monomer having a polar group is graft polymerized to a polycarbonate resin or a polyarylate resin is used as the binder resin, and a filler and a CTM are included therein. Such a graft copolymer can be used alone or in combination with another polycarbonate or polyarylate resin.

When the CTL is not the outermost layer of the photoreceptor, specific examples of the binder resin for use in the CTL include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM in the CTL is preferably from 20 to 300 parts by weight, and more preferably from 40 to 150 parts by weight, per 100 parts by weight of the binder resin included in the CTL. The thickness of the CTL is preferably not greater than 25 μm in view of resolution of the resultant images and response (i.e., photosensitivity) of the resultant photoreceptor. In addition, the thickness of the CTL is preferably not less than 5 μm in view of charge potential. The lower limit of the thickness changes depending on the image forming system for which the photoreceptor is used (in particular, depending on the charge potential to be formed on the photoreceptor by the image forming apparatus).

Suitable solvents for use in the CTL coating liquid include, but are not limited to, tetrahydrofuran, dioxane, toluene, dichloromethane, monochlorobenzene, dichloroethane, cyclohexanone, methyl ethyl ketone, acetone and the like solvents.

The CTL may include additives such as plasticizers and leveling agents. Specific examples of the plasticizers include known plasticizers, which are used for plasticizing resins, such as dibutyl phthalate, dioctyl phthalate and the like. The addition quantity of the plasticizer is 0 to 30% by weight of the binder resin included in the CTL.

Next, the single-layer photosensitive layer will be explained.

The photosensitive layer can be formed by coating a coating liquid in which a CGM, a CTM, and a binder resin are dissolved or dispersed in a proper solvent, and then drying the coated liquid. The photosensitive layer may include the CTMs mentioned above to form a functionally-separated photosensitive layer. The photosensitive layer may include additives such as plasticizers, leveling agents and antioxidants.

When the photosensitive layer is the outermost layer of the photoreceptor, at least a graft copolymer in which a monomer having a polar group is graft polymerized to a polycarbonate resin or a polyarylate resin is used as the binder resin, and a filler, a CTM, and a CGM are included therein. Such a graft copolymer can be used alone or in combination with another polycarbonate or polyarylate resin.

When the CTL is not the outermost layer of the photoreceptor, suitable binder resins for use in the photosensitive layer include the resins mentioned above for use in the CTL. The resins mentioned above for use in the CGL can be added as a binder resin.

The content of the CGM is preferably from 5 to 40 parts by weight per 100 parts by weight of the binder resin included in the photosensitive layer. The content of the CTM is preferably from 0 to 190 parts by weight, and more preferably from 50 to 150 parts by weight, per 100 parts by weight of the binder resin included in the photosensitive layer.

The single-layer photosensitive layer can be formed by coating a coating liquid in which a CGM and a binder resin and optionally a CTM are dissolved or dispersed in a solvent such as tetrahydrofuran, dioxane, dichloroethane, cyclohexane, etc. by a coating method such as dip coating, spray coating, bead coating, or the like. The thickness of the single layer photosensitive layer is preferably from 5 to 25 μm.

In the photoreceptor of the present invention, an undercoat layer may be formed between the electroconductive substrate and the photosensitive layer. The undercoat layer includes a resin as a main component. Since a photosensitive layer is typically formed on the undercoat layer by coating a coating liquid including an organic solvent, the resin in the undercoat layer preferably has good resistance to general organic solvents. Specific examples of such resins include, but are not limited to, water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method mentioned above for use in the photosensitive layer. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene or an inorganic compound such as $SiO_2$, $SnO_2$, $TiO_2$, indium tin oxide (ITO) or $CeO_2$ which is formed by a vacuum evaporation method is also preferably used as the undercoat layer. The thickness of the undercoat layer is preferably 0 to 5 μm.

In the photoreceptor of the present invention, a protective layer may be formed overlying the photosensitive layer as the outermost layer to protect the photosensitive layer.

In the protective layer, at least a graft copolymer in which a monomer having a polar group is graft polymerized to a polycarbonate resin or a polyarylate resin is used as the binder resin, and a filler is included therein. Such a graft copolymer can be used alone or in combination with another polycarbonate or polyarylate resin.

The thickness of the protective layer is preferably from 1.0 to 8.0 μm. Since the photoreceptor is repeatedly used, the photoreceptor has to have high mechanical durability and high abrasion resistance. In image forming apparatus, ozone and NOx gasses are produced by chargers, etc., and adhere to the photoreceptor used therein. When these substances are present on the photoreceptor, blurred images are produced. In order to prevent such a blurred image problem, the surface of the photoreceptor is preferably abraded to some extent. When considering that a photoreceptor is repeatedly used for a long period of time, the protective layer preferably has a thickness not less than 1.0 μm. When the thickness is greater than 8.0 μm, problems such that residual potential of the resultant photoreceptor tends to increase and fine dot reproducibility of the resultant images deteriorates.

The protective layer can be formed by a coating method such as dip coating, ring coating and spray coating methods. Among these coating methods, a spray coating method in which a misty coating liquid formed by spraying the coating liquid from a nozzle having a fine opening is adhered on the surface of the photosensitive layer to form a layer thereon is preferably used.

Next, a preferred spray coating method will be explained in detail.

When a protective layer coating liquid whose solvent does not dissolve the photosensitive layer is coated on the photosensitive layer by a spray coating method, the resultant protective layer does not mix with the photosensitive layer at their boundary portion. Therefore the protective layer and photosensitive layer have a discontinuous structure, i.e., a clear interface is formed therebetween. When a photoreceptor has such a discontinuous structure, image qualities of the images initially produced by the photoreceptor are good. However, such a photoreceptor has poor mechanical durability and unstable electrophotographic properties, and therefore when the photoreceptor is repeatedly used for a long period of time, undesired images are produced. Therefore, the protective layer coating liquid has to include a solvent dissolving at least a portion of the resin in the photosensitive layer.

When a protective layer coating liquid including a solvent capable of dissolving the photosensitive layer is coated on the photosensitive layer by the spray coating method, the resultant protective layer is mixed with the photosensitive layer at their boundary portion. Therefore the protective layer and photosensitive layer have a continuous structure. The photoreceptor having such a continuous structure has good mechanical durability and stable electrophotographic properties. However, when the protective layer is excessively mixed with the photosensitive layer, image qualities deteriorate.

Therefore, it is preferable that a protective layer coating liquid including a solvent capable of dissolving the photosensitive layer is coated by a spray coating method such that the protective layer and photosensitive layer have a continuous structure as specified above. Such a photoreceptor has good mechanical durability and stable electrophotographic properties, and therefore can produce images having good image qualities even when repeatedly used for a long period of time.

The degree of mixing of the protective layer with the photosensitive layer can be influenced by the time from a time at which the coating liquid adheres on the photosensitive layer to a time at which the content of the solvent dissolving the resin in the photosensitive layer included in the protective layer coating liquid reaches a certain content. Namely, the degree of mixing is largely influenced by the quantity of the coating liquid adhered on the surface of the photoreceptor and the evaporating speed of the solvent included in the coating liquid.

When a solvent which has low evaporating speed is used in the coating liquid, the photosensitive layer is easily dissolved by the protective layer coating liquid.

In the present invention, the evaporation speed of the solvent in the protective layer coating liquid is mainly controlled by the following factors:

(1) conditions of the protective layer coating liquid, such as species of the solvent used, and solid content of the coating liquid;

(2) conditions of the spray coating method used, such as discharge rate, discharge pressure, feeding speed of spray gun, and the number of coating times; and (3) environmental conditions in coating, such as temperature, and amount of discharged air.

The protective layer of the present invention is preferably formed by the following method.

A protective layer coating liquid including a binder resin, a filler and a solvent, which can dissolve the binder resin and the resin present on the surface of the photosensitive layer, is coated on the photosensitive layer by a spray coating method. At this point, the following relationship is preferably satisfied:

$$1.2 < A/B < 2.0$$

wherein A represents a weight of a film of the protective layer per unit area, which is prepared by coating the protective layer coating liquid directly on the electroconductive substrate to be used by the spray coating method and then drying the coated liquid at room temperature for 60 minutes, and B represents a weight of the coated film of the protective layer per unit area, which is prepared by perfectly drying the film.

At this point, the "perfectly dried film" means a film of the protective layer which is dried by being heated such that the solvent remaining therein is not greater than 1000 ppm.

Next, the way to measure the weight (i.e., A) of the coated film which has been settled for 60 minutes after being coated, and the weight (i.e., B) of the perfectly dried film will be explained.

(1) the weight (G1) of a cylinder serving as an electroconductive substrate is measured;

(2) a protective layer coating liquid is coated on the periphery surface of the cylinder by a spray coating method to form a film of the protective layer on the cylinder;

(3) the coated film is settled for 60 minutes while not being specially heated and then the weight (G2) of the cylinder having the coated film is measured; and (4) the coated film is heated to prepare a perfectly-dried protective layer and the weight (G3) of the cylinder having the perfectly-dried protective layer is measured.

At this point, A can be determined as the difference between G2 and G1 (G2−G1), and B can be determined as the difference between G3 and G1 (G3−G1).

When the protective layer is formed under a condition such that the ratio A/B is less than 1.2, the misty coating liquid becomes unstable. Namely, when the coating liquid is sprayed, the misty coating liquid tends to solidify. The solidified particles of the coating liquid adhere to the surface of the photosensitive layer, and thereby undesired images tend to be produced.

When the protective layer is formed under a condition such that the ratio A/B is greater than 2.0, the mixing of the protective layer with the photosensitive layer tends to excessively proceed. Namely, the standard deviation σ becomes large. As mentioned above, when the standard deviation is greater than D/5, various properties of the resultant photoreceptor deteriorate.

Thus, by forming the protective layer while controlling the coating conditions such that the ratio A/B is greater than 1.2 and less than 2.0, the standard deviation falls into the preferable range mentioned above, and thereby a photoreceptor having good properties can be prepared.

The protective layer coating liquid includes at least one solvent which can dissolve the resin included in the photosensitive layer and the resin included in the protective layer. The solvent is used alone or in combination with another solvent. When the solvent has high volatility, the coating liquid tends to solidify when being sprayed, and the solidified particles adhere on the photosensitive layer, resulting in formation of coating defects. In contrast, when the solvent has low volatility, the surface of the photosensitive layer tends to be largely dissolved, resulting in excessive increase of the standard deviation σ of the maximum thickness. Therefore it is preferable to use a mixture of a solvent having high volatility and a solvent having low volatility. The boiling point of the solvent having high volatility is preferably from 50° C. to 80° C. The boiling point of the solvent having low volatility is preferably from 130° C. to 160° C. By using a protective layer coating liquid including such a mixture solvent, mixing of the protective layer with photosensitive layer can be easily controlled.

When only a solvent having a boiling point not greater than 80° C. is used in the protective layer coating liquid, the ratio A/B tends to become lower than 1.2, resulting in occurrence of the problems mentioned above. In contrast, when only a solvent having a boiling point not less than 80° C. is used in the protective layer coating liquid, the coated liquid tends to flow on the surface of the photosensitive layer during preliminary drying process in which the coated liquid is dried at room temperature, resulting in formation of the protective layer having an undesired structure. In particular, when only a solvent having a boiling point not less than 130° C. is used in the protective layer coating liquid, not only the protective layer has an undesired structure, but also the ratio A/B tends to become greater than 2.0, resulting in occurrence of the problems mentioned above.

Specific examples of the solvent having a boiling point of from 50° C. to 80° C. include, but are not limited to, tetrahydrofuran and dioxolan. Specific examples of the solvent having a boiling point of from 130° C. to 160° C. include, but are not limited to, cyclohexanone, cyclopentanone, and anisole. When a protective layer coating liquid including an organic solvent having a boiling point of from 50° C. to 80° C. and another organic solvent having a boiling point of from 130° C. to 160° C. is coated to form a protective layer on a photosensitive layer, the coated liquid is at first preliminarily dried at room temperature. Then the coated protective layer is heated to be perfectly dried. The properties of the photoreceptor largely change depending on the heating conditions. It is preferable that the drying temperature is from 130° C. to 160° C. and the drying time is from 10 minutes to 60 minutes. When the drying temperature is too low or the drying time is too short, a large amount of the solvent remains in the photoreceptor, resulting in increase of the lighted-area potential at initial stage of the resultant photoreceptor. In addition, when the photoreceptor is repeatedly used, potential formed on the photoreceptor varies, and thereby the image qualities largely vary. In contrast, when the drying temperature is too high or the drying time is too long, the crystallinity or crystal form of the pigment in the CGL (photosensitive layer) tends to change and/or low molecular weight components such as an antioxidant and a plasticizer tends to release from the CTL (photosensitive layer). Thereby photosensitivity and charge properties of the resultant photoreceptor deteriorate.

When a protective layer coating liquid including a solvent having a boiling point of from 50° C. to 80° C. and another organic solvent having a boiling point of from 130° C. to 160° C. is used, the preliminary drying conditions are such that the protective-layer coated photoreceptor is settled for more than 5 minutes while being rotated under the same conditions as those in the spray coating process.

It is possible to control the film qualities of the protective layer by controlling the solid content of the protective layer coating liquid. When the solid content of the liquid coated on the photosensitive layer is low, it takes a relatively long time until the coated liquid is dried. Therefore the surface of the photosensitive layer tends to be largely dissolved, resulting in increase of the standard deviation σ of the maximum thickness. In contrast, when the solid content is high, the sprayed coating liquid tends to solidify in the misty state, resulting in adhesion of solidified particles on the photosensitive layer, and thereby coating defects are formed in the resultant protective layer. Therefore, the solid content of the protective layer is preferably from 3.0 to 6.0% by weight.

The spray coating conditions change depending on the spray gun used. Therefore the following conditions are the typical conditions.

The diameter of the opening of the spray gun is preferably from 0.5 to 0.8 mm. When the diameter is out of this range, it is hard to prepare a coating liquid in a misty state, and therefore a film having good film qualities is hardly prepared.

The discharge rate of the coating liquid is preferably from 5 to 25 cc/min. When the discharge rate is low, the coating speed is slow, resulting in decrease of productivity. In contrast, when the discharge rate is high, there is a case in which the standard deviation becomes too large. In addition, the quantity of the coated liquid becomes large, and thereby the coated liquid tends to flow, resulting in formation of an uneven protective layer film.

The coating liquid discharging pressure (hereinafter referred to as discharging pressure) is preferably from 1.0 to 3.0 kg/cm$^2$. When the discharging pressure is too low, the diameter of the mist of the coating liquid is large, and thereby the coated layer tends to have an undesired structure. When the discharging pressure is too high, the mist bounces from the surface of the photosensitive layer, resulting in formation of a layer having an undesired structure and deterioration of film forming efficiency.

The revolution number of the photoreceptor on which the protective layer is to be formed is preferably from 120 to 640 rpm, and the feeding speed of the spray gun is preferably from 5 to 40 mm/sec. If these conditions are off-balanced, the coated layer has an undesired spiral structure.

The distance between the spray gun and the photoreceptor on which the protective layer is to be formed is preferably from 3 to 15 cm. When the distance is too short, a stable mist cannot be formed, resulting in formation of a protective layer having an undesired structure. When the distance is too long, the efficiency of adhesion of the coating liquid on the surface of the photosensitive layer deteriorates.

The thickness of the coated liquid per one coating operation performed by a spray gun is preferably from 0.5 to 2.0 μm on a dry basis. When this single-coating-operation thickness is too thin, the desired protective layer film cannot be prepared even when the other coating conditions are controlled, and in addition productivity deteriorates. In contrast, when the thickness is too thick, the standard deviation σ tends to become large, resulting in occurrence of the problems mentioned above.

The preferable condition of one of the factors mentioned above changes depending on the conditions of the other factors. Namely, when the condition of a factor is changed, there is a possibility that all the other factors have to be changed. The preferable conditions should be determined while considering the mist state of the coating liquid, the surface condition of the photoreceptor, the dispersion condition of the filler in the coating liquid, the adhesion efficiency of the sprayed coating liquid, etc.

As mentioned above, when a spray coating method is used, coating is preferably performed such that the ratio A/B is greater than 1.2 and less than 2.0 as mentioned above.

The method of forming the protective layer is not limited to the spray coating method mentioned above, and any coating methods can be used as long as the resultant protective layer has the desired film properties.

The protective layer may include a CTM to decrease residual potential and improve the response of the resultant photoreceptor. Specific examples of the CTMs include the CTMs mentioned above for use in the CTL. When a low molecular weight CTM is used in the protective layer, the concentration of the CTM may be changed in the thickness direction of the protective layer. It is preferable that the concentration of the CTM at the surface of the protective layer is relatively low compared to that at the bottom of the protective layer, to improve the abrasion resistance thereof.

A charge transport polymer which has both a charge transport function and a binder function can be preferably used in the protective layer. A protective layer including such a charge transport polymer has good abrasion resistance.

In the photoreceptor of the present invention, one or more additives such as antioxidants, plasticizers, lubricants, ultraviolet absorbents, low molecular weight charge transport materials and leveling agents can be used in one or more layers to improve the stability to withstand environmental conditions, namely to avoid decrease of photosensitivity and increase of residual potential of the resultant photoreceptor.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-Containing Compounds triphenylphosphine, tri(nonylphenyl)phosphine, tri(di-nonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-Containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes carnauba wax, candelilla wax, beeswax, spermaceti, insect wax, montan wax, and the like.

(h) Silicone Compounds

Silicone oils for use in the present invention will be explained in detail.

Specific examples of the silicone oils include, but are not limited to, silicone oils having the following formula (10), such as dimethyl silicone oils, methylphenyl silicone oils, methyl hydrogen silicone oils, polyether-modified silicone oils, epoxy-modified silicone oils, amino-modified silicone oils, carboxyl-modified silicone oils, mercapto-modified silicone oils, carbinol-modified silicone oils, methacrylic-modified silicone oils, alkyl-modified silicone oils, phenol-modified silicone oils, fatty-acid-ester-modified silicone oils, vinyl-modified silicone oils, alkoxy-modified silicone oils, and heterogeneous-functional-group-modified silicone oils:

(10)

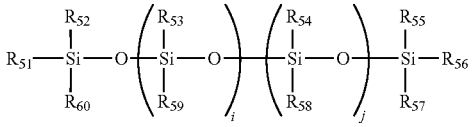

wherein each of i and j independently represents 0 or a positive integer, and the relationship $i=j\neq 0$ is satisfied.

When the formula (10) represents a dimethyl silicone oil, all of $R_{51}$ to $R_{60}$ each represent a methyl group.

When the formula (10) represents a methylphenyl silicone oil, each of $R_{51}$ to $R_{60}$ independently represents a methyl group, or a phenyl group which may have a substitutent group, wherein at least one of $R_{51}$ to $R_{60}$ represents a methyl group and another represents a phenyl group which may have a substitutent group (i.e., all of $R_{51}$ to $R_{60}$ each do not simultaneously represent a methyl group or a phenyl group which may have a substitutent group).

When the formula (10) represents a methyl hydrogen silicone oil, each of $R_{51}$ to $R_{60}$ independently represents a hydrogen atom or a methyl group, wherein at least one of $R_{51}$ to $R_{60}$ represents a hydrogen atom and another represents a methyl group (i.e., all of $R_{51}$ to $R_{60}$ each do not simultaneously represent a hydrogen atom or a methyl group).

When the formula (10) represents a polyether-modified silicone oil, each of $R_{51}$ to $R_{60}$ independently represents an alkyl group having 1 to 3 carbon atoms or $—R_{61}—(C_2H_4O)_g(C_3H_6O)_h—R_{62}$, wherein $R_{61}$ represents an alkyl group, $R_{62}$ represents an alkyl group, a hydroxyl group, or $—R_{63}—OH$, wherein $R_{63}$ represents an alkyl group, and each of g and h independently represents 0 or a positive integer; and wherein at least one of $R_{51}$ to $R_{60}$ represents $—R_{61}—(C_2H_4O)_g(C_3H_6O)_h—R_{62}$.

When the formula (10) represents an epoxy-modified silicone oil, each of $R_{51}$ to $R_{60}$ independently represents an alkyl group having 1 to 3 carbon atoms or a substitutent group having the following formulae (11) or (12):

(11)

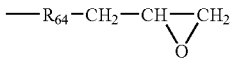

(12)

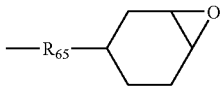

wherein each of $R_{64}$ and $R_{65}$ independently represents an alkyl group; and wherein at least one of $R_{51}$ to $R_{60}$ represents a substitutent group having the formulae (11) or (12).

When the formula (10) represents an amino-modified silicone oil, each of $R_{51}$ to $R_{60}$ independently represents an alkyl group having 1 to 3 carbon atoms, $—R_{66}—NH—R_{67}—NH_2$, or $—R_{68}—NH_2$, wherein each of $R_{66}$, $R_{67}$, and $R_{68}$ independently represents an alkyl group; and wherein at least one of $R_{51}$ to $R_{60}$ represents $—R_{66}—NH—R_{67}—NH_2$ or $—R_{68}—NH_2$.

When the formula (10) represents a carboxyl-modified silicone oil, each of $R_{51}$ to $R_{60}$ independently represents an alkyl group having 1 to 3 carbon atoms, an alkoxy group having 1 to 3 carbon atoms, or —$R_{69}$COOH, wherein $R_{69}$ represents an alkyl group; and wherein at least one of $R_{51}$ to $R_{60}$ represents —$R_{69}$COOH.

When the formula (10) represents a mercapto-modified silicone oil, each of $R_{51}$ to $R_{60}$ independently represents an alkyl group having 1 to 3 carbon atoms or —$R_{70}$—SH, wherein $R_{70}$ represents an alkyl group; and wherein at least one of $R_{51}$ to $R_{60}$ represents —$R_{70}$—SH.

When the formula (10) represents a carbinol-modified silicone oil, each of $R_{51}$ to $R_{60}$ independently represents an alkyl group having 1 to 3 carbon atoms, an alkoxy group having 1 to 3 carbon atoms, or —$R_{71}$—OH, wherein $R_{71}$ represents an alkyl group; and wherein at least one of $R_{51}$ to $R_{60}$ represents —$R_{71}$—OH.

When the formula (10) represents a methacrylic-modified silicone oil, each of $R_{51}$ to $R_{60}$ independently represents an alkyl group having 1 to 3 carbon atoms, an alkoxy group having 1 to 3 carbon atoms, —$R_{72}$—C($CH_3$)=$CH_2$, or —$R_{73}$—OCO—C($CH_3$)=$CH_2$, wherein each of $R_{72}$ and $R_{73}$ independently represents an alkyl group; and wherein at least one of $R_{51}$ to $R_{60}$ represents —$R_{72}$—C($CH_3$)=$CH_2$ or —$R_{73}$—OCO—C($CH_3$)=$CH_2$.

When the formula (10) represents an alkyl-modified silicone oil, each of $R_{51}$ to $R_{60}$ independently represents an alkyl group having 1 or more carbon atoms, wherein at least one of them represents an alkyl group having 4 or more carbon atoms.

When the formula (10) represents a phenol-modified silicone oil, each of $R_{51}$ to $R_{60}$ independently represents an alkyl group having 1 to 3 carbon atoms, an alkoxy group having 1 to 3 carbon atoms, or a substitutent group having the following formula (13):

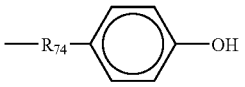

(13)

wherein $R_{74}$ represents an alkyl group; and wherein at least one of $R_{51}$ to $R_{60}$ represents a substitutent group having the formula (13).

When the formula (10) represents a fatty-acid-ester-modified silicone oil, each of $R_{51}$ to $R_{60}$ independently represents an alkyl group having 1 to 3 carbon atoms, an alkoxy group having 1 to 3 carbon atoms, or —OCO—$R_{76}$, wherein $R_{76}$ represents an alkyl group; and wherein at least one of $R_{51}$ to $R_{60}$ represents —OCO—$R_{76}$.

When the formula (10) represents a vinyl-modified silicone oil, each of $R_{51}$ to $R_{60}$ independently represents an alkyl group having 1 to 3 carbon atoms, an alkoxy group having 1 to 3 carbon atoms, a phenyl group which may have a substitutent group, or —$CH_2$=$CH_2$, wherein at least one of $R_{51}$ to $R_{60}$ represents —$CH_2$=$CH_2$.

When the formula (10) represents an alkoxy-modified silicone oil, each of $R_{51}$ to $R_{60}$ independently represents an alkyl group having 1 to 3 carbon atoms or an alkoxy group having 1 or more carbon atoms, wherein at least one of $R_{51}$ to $R_{60}$ represents an alkoxy group having 4 or more carbon atoms.

When the formula (10) represents a heterogeneous-functional-group-modified silicone oil, each of $R_{51}$ to $R_{60}$ independently represents an alkyl group having 1 to 3 carbon atoms, an alkoxy group having 1 to 3 carbon atoms, an amino group, an epoxy group, or a polyether group, wherein at least two of $R_{51}$ to $R_{60}$ each represent an alkoxy group having 1 to 3 carbon atoms, an amino group, an epoxy group, or a polyether group.

When the formula (10) represents a fluorine-modified silicone oil, each of $R_{51}$ to $R_{60}$ independently represents an alkyl group having 1 to 3 carbon atoms, an alkoxy group having 1 to 3 carbon atoms, or —$R_{77}$—$CF_3$, wherein $R_{77}$ represents an alkyl group; and wherein at least one of $R_{51}$ to $R_{60}$ represents —$R_{77}$—$CF_3$.

The silicone oils for use in the present invention are not limited to the above-mentioned silicone oils. Silicone oils having the formula (10) can be used. These silicone oils may have a cyclic structure.

The layer preferably includes the silicone oil in an amount of from 0.5 to 20% by weight based on solid content of the layer. When the amount of the silicone oil is too small, cleanability of the photoreceptor deteriorates. When the amount of the silicone oil is too large, residual potential increases and abrasion resistance deteriorates.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy)acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Hereinafter the image forming apparatus of the present invention will be explained referring to drawings.

Figure 10:
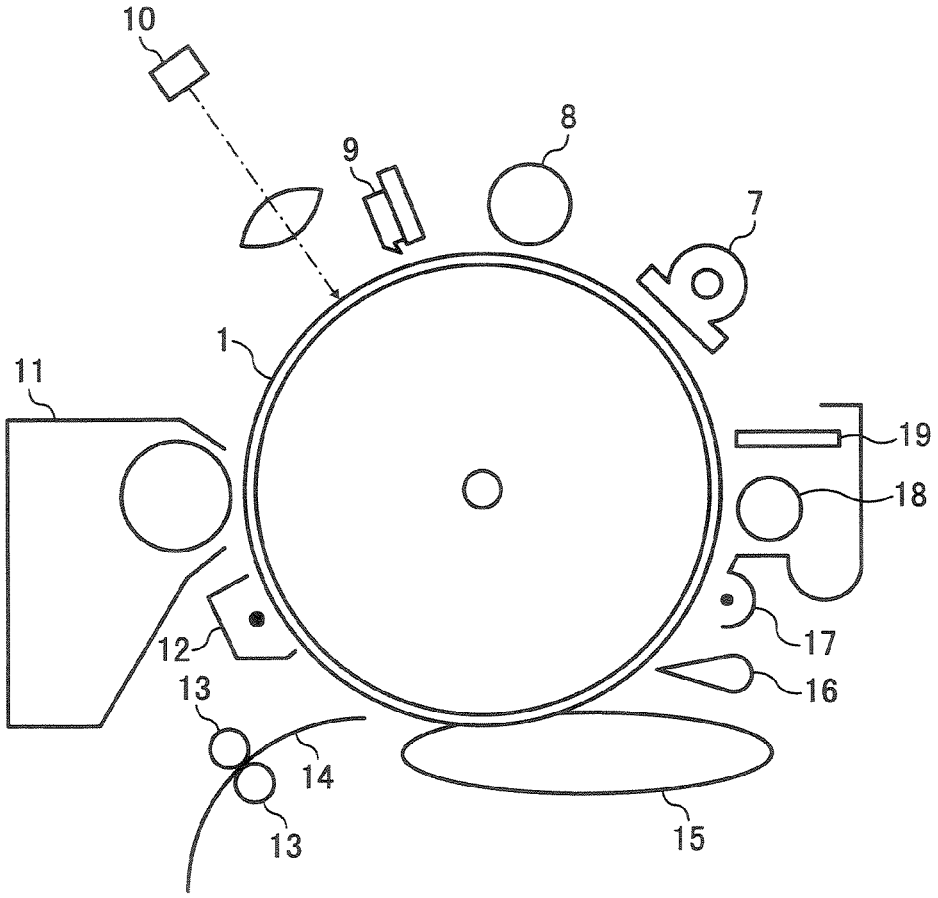
FIG. 10 is a schematic view illustrating an embodiment of the image forming apparatus of the present invention.

FIG. 10 is a schematic view of an embodiment of the image forming apparatus of the present invention.

In FIG. 10, numeral 1 denotes a photoreceptor. The photoreceptor 1 is the photoreceptor of the present invention. Although the photoreceptor 1 has a cylindrical shape in FIG. 10, but sheet photoreceptors, endless belt photoreceptors or the like can be used.

Around the photoreceptor 1, a discharging lamp 7 configured to discharge residual potential remaining on the surface of the photoreceptor 1, a charger 8 configured to charge the photoreceptor 1, an eraser 9 configured to erase an undesired portion of the charged area of the photoreceptor, an image irradiator 10 configured to irradiate the photoreceptor 1 with light containing image information to form an electrostatic latent image on the photoreceptor 1, an image developer 11 configured to develop the latent image with a toner to form a toner image on the photoreceptor 1, and a cleaning unit including a cleaning brush 18 and a cleaning blade 19 configured to clean the surface of the photoreceptor 1 are arranged while contacting or being set closely to the photoreceptor 1. The toner image formed on the photoreceptor 1 is transferred on a receiving paper 14 timely fed by a pair of registration rollers 13 at the transfer belt 15. The receiving paper 14 having the toner image thereon is separated from the photoreceptor 1 by a separating pick 16.

In the image forming apparatus of the present invention, a pre-transfer charger 12 and a pre-cleaning charger 17 may be arranged if desired.

As the charger 8, the pre-transfer charger 12, and the pre-cleaning charger 17, all known chargers such as corotrons, scorotrons, solid state chargers, and charging rollers can be used. As the charger 8, contact chargers such as charging rollers, and proximity chargers in which, for example, a charging roller charges the photoreceptor while close to but not touching the image forming area of the surface of the photoreceptor, are typically used. When the photoreceptor is charged by the charger 8, a DC voltage overlapped with an AC voltage is preferably applied to the photoreceptor to avoid uneven charging.

As the transfer device, the above-mentioned chargers can be used. Among the chargers, a combination of the transfer charger and the separating charger is preferably used.

In FIG. 10, the toner image is directly transferred onto the receiving paper 14. However, an image forming method in which the toner image on the photoreceptor 1 is transferred onto an intermediate transfer medium and then transferred onto the paper can be used to improve the durability of the photoreceptor and produce high quality full color images.

Suitable light sources for use in the image irradiator 10 and the discharging lamp 7 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 10, but also other processes using light irradiation, such as a transfer process including light irradiation, a discharging process, a cleaning process including light irradiation and a pre-exposure process.

When the toner image formed on the photoreceptor 1 by the developing unit 6 is transferred onto the receiving paper 14, all of the toner images are not transferred on the receiving paper 14, and residual toner particles remain on the surface of the photoreceptor 1. The residual toner is removed from the photoreceptor 1 by the fur blush 18 and the cleaning blade 19. The residual toner remaining on the photoreceptor 1 can be removed by only the cleaning brush. Suitable cleaning blushes include known cleaning blushes such as fur blushes and magnetic-fur blushes.

When the photoreceptor 1 which is previously charged positively (or negatively) is exposed to light containing image information, an electrostatic latent image having a positive (or negative) charge is formed on the photoreceptor 1. When the latent image having a positive (or negative) charge is developed with a toner having a negative (or positive) charge, a positive toner image can be formed on the photoreceptor. In contrast, when the latent image having a positive (negative) charge is developed with a toner having a positive (negative) charge, a negative toner image (i.e., a reversal image) can be formed on the photoreceptor. As the developing method, known developing methods can be used. In addition, as the discharging methods, known discharging methods can also be used.

Figure 11:
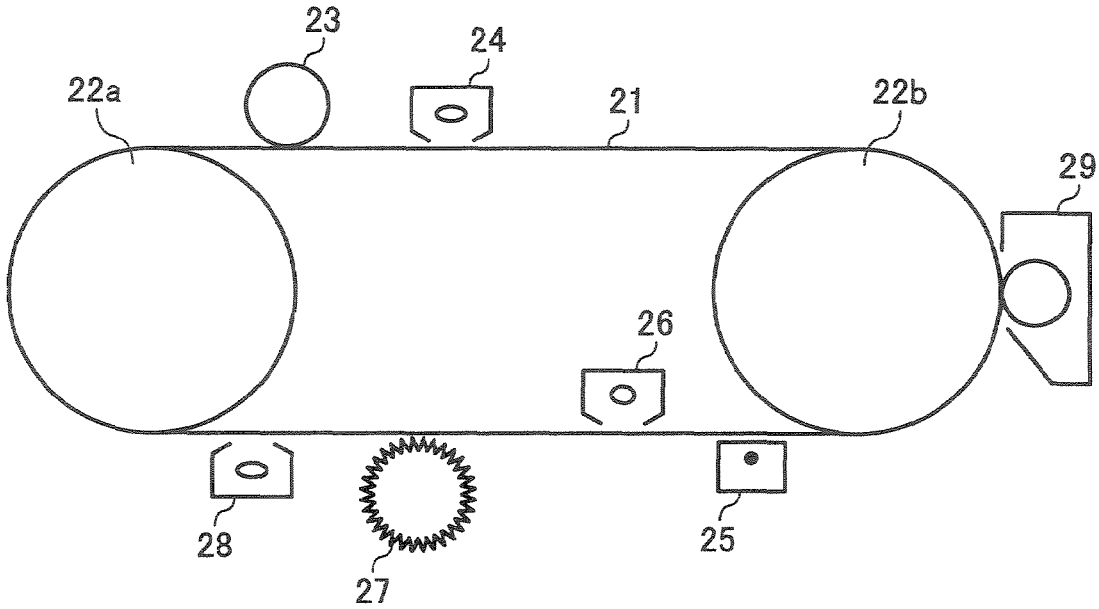
FIG. 11 is a schematic view illustrating another embodiment of the image forming apparatus of the present invention.

FIG. 11 is a schematic view illustrating another embodiment of the image forming apparatus of the present invention. In this embodiment, a belt-shaped photoreceptor 21 is used. The photoreceptor 21 is the photoreceptor of the present invention.

The belt-shaped photoreceptor 21 is rotated by rollers 22*a* and 22*b*. The photoreceptor 21 is charged with a charger 23, and then exposed to light containing image information emitted by a light irradiator 24 to form an electrostatic latent image on the photoreceptor 21. The latent image is developed with a developing unit 29 to form a toner image on the photoreceptor 21. The toner image is transferred onto a receiving paper (not shown) using a transfer charger 25. After the toner image transferring process, the surface of the photoreceptor 21 is cleaned with a cleaning brush 27 after performing a pre-cleaning light irradiating operation using a pre-cleaning light irradiator 26. Then the charges remaining on the photoreceptor 21 are discharged by being exposed to light emitted by a discharging light source 28. In the pre-cleaning light irradiating process, light irradiates the photoreceptor 21 from the side of the substrate thereof. In this case, the substrate has to be light-transmissive.

The image forming apparatus of the present invention is not limited to the image forming units as shown in FIGS. 10 and 11. For example, in FIG. 11, the pre-cleaning light irradiating operation can be performed from the photosensitive layer side of the photoreceptor 21. In addition, the light irradiation in the light image irradiating process and the discharging process may be performed from the substrate side of the photoreceptor 21.

Further, a pre-transfer light irradiation operation, which is performed before transferring the toner image, a preliminary light irradiation operation, which is performed before the light containing image information irradiation operation, and other light irradiation operations may also be performed.

The above-mentioned image forming unit may be fixedly set in a copier, a facsimile or a printer. However, the image forming unit may be set therein as a process cartridge. The process cartridge means an image forming unit which includes at least a photoreceptor and a housing containing the photoreceptor. In addition, the process cartridge may include one of a charger, an image irradiator, an image developer, an image transferrer, a cleaner and a discharger.

Figure 12:
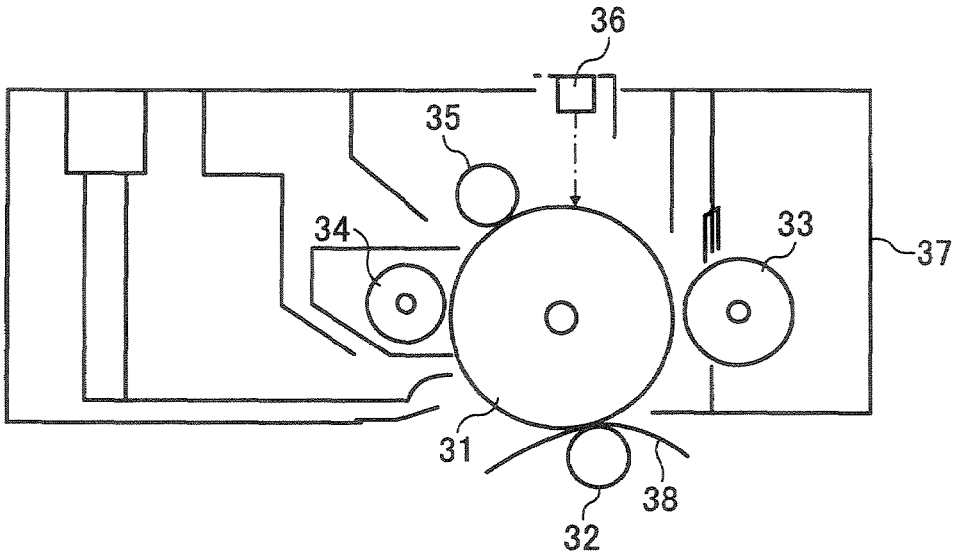
FIG. 12 is a schematic view illustrating an embodiment of the process cartridge of the present invention.

FIG. 12 is a schematic view illustrating an embodiment of the process cartridge of the present invention. In FIG. 12, the process cartridge includes a photoreceptor 31, a charger 35 configured to charge the photoreceptor 31 an image irradiator 36 configured to irradiate the photoreceptor 31 with light containing image information to form an electrostatic latent image on the photoreceptor 31, an image developer (a developing roller) 33 configured to develop the latent image with a toner to form a toner image on the photoreceptor 31, an image transferrer 32 configured to transfer the toner image onto a receiving paper 38, a cleaning brush 34 configured to clean the surface of the photoreceptor 31, and a housing 37. The photoreceptor 31 is the photoreceptor of the present invention. The process cartridge of the present invention is not limited thereto.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Synthesis of Vinylpyridine Graft Bisphenol Z-Form Polycarbonate

At first, 3.0 g of a bisphenol Z-form polycarbonate (PANLITE® TS2050 from Teijin Chemicals Ltd.), 0.3 g of 4-vinylpyridine, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polycarbonate was prepared.

Next, the crude graft polycarbonate was dissolved in dichloromethane, and then water was added thereto so as to wash the organic phase (i.e., dichloromethane phase). The organic phase was subjected to reprecipitation again using methanol, and then the precipitates were isolated and dried. Thus, 2.97 g of a pale yellowish-white-colored graft polycarbonate (1) was prepared.

The graft polycarbonate (1) had a weight average molecular weight of 146,300 when measured by GPC. It was clear from H-NMR analysis that 1 unit of vinylpyridine was grafted to 688 units of bisphenol Z-form carbonate. This graft amount was calculated from an integration value of 4 protons of vinylpyridine ring and that of 8 protons of benzene ring.

The bisphenol Z-form polycarbonate (PANLITE® TS2050 from Teijin Chemicals Ltd.), which was a raw material, had a weight average molecular weight of 147,000 when measured by GPC.

Synthesis Example 2

Synthesis of Acrylic Acid Graft Bisphenol Z-Form Polycarbonate

At first, 3.0 g of a bisphenol Z-form polycarbonate (PANLITE® TS2050 from Teijin Chemicals Ltd.), 0.3 g of acrylic acid, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polycarbonate was prepared.

Next, the crude graft polycarbonate was dissolved in dichloromethane, and then water was added thereto so as to wash the organic phase (i.e., dichloromethane phase). The organic phase was subjected to reprecipitation again using methanol, and then the precipitates were isolated and dried. Thus, 2.95 g of a white-colored graft polycarbonate (2) was prepared.

The graft polycarbonate (2) had a weight average molecular weight of 146,700 when measured by GPC.

The bisphenol Z-form polycarbonate (PANLITE® TS2050 from Teijin Chemicals Ltd.), which was a raw material, had a weight average molecular weight of 147,000 when measured by GPC.

Synthesis Example 3

Synthesis of Bisphenol Z-Form Polyarylate

At first, 15.0 mg (0.1 mmol) of 4-t-butylphenol (i.e., a molecular weight controlling agent) and 1.52 g (38 mmol) of sodium hydrate were dissolved in 50 ml of water, and then 2.68 g (10 mmol) of 1,1'-bis(4-hydroxyphenyl)cyclohexane was added thereto. Further, 13.6 mg (0.06 mmol) of BTEAC (benzyltriethylammonium chloride) was added thereto as a phase-transfer catalyst. Thus, an aqueous phase was prepared.

On the other hand, 2.03 g (10.02 mmol) of a mixture in which terephthaloyl chloride was mixed with isophthaloyl chloride at a ratio of 1/1 was dissolved in 40 ml of dichloromethane. Thus, an organic phase was prepared.

The aqueous phase was contained in a reaction vessel, and the organic phase was added thereto while agitating the aqueous phase at a revolution of 650 ppm at 20° C. The mixture was subjected to a reaction for 5 hours, and then the agitation was stopped. The aqueous phase and the organic phase were separated. The organic phase was neutralized with acetic acid solution, and then washed with water for 3 times. The organic phase was subjected to reprecipitation using methanol, and then the precipitates were isolated and dried. Thus, 3.81 g of a white-colored polyarylate (3) was prepared.

The polymerization yield was 95.4%. The polyarylate (3) had a weight average molecular weight of 153,500 when measured by GPC.

Synthesis Example 4

Synthesis of Vinylpyridine Graft Bisphenol Z-Form Polyarylate

At first, 3.0 g of the bisphenol Z-form polyarylate (3), 0.3 g of 4-vinylpyrydine, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polyarylate was prepared.

Next, the crude graft polyarylate was dissolved in dichloromethane, and then water was added thereto so as to wash the organic phase (i.e., dichloromethane phase). The organic phase was subjected to reprecipitation again using methanol, and then the precipitates were isolated and dried. Thus, 2.96 g of a pale yellowish-white-colored graft polyarylate (4) was prepared.

The graft polyarylate (4) had a weight average molecular weight of 153,200 when measured by GPC. It was clear from H-NMR analysis that 1 unit of vinylpyridine was grafted to 635 units of bisphenol Z-form arylate. This graft amount was calculated from an integration value of 4 protons of vinylpyridine ring and that of 12 protons of benzene ring.

Synthesis Example 5

Synthesis of Acrylic Acid Graft Bisphenol Z-Form Polyarylate

At first, 3.0 g of the bisphenol Z-form polyarylate (3), 0.3 g of acrylic acid, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polyarylate was prepared.

Next, the crude graft polyarylate was dissolved in dichloromethane, and then water was added thereto so as to wash the organic phase (i.e., dichloromethane phase). The organic phase was subjected to reprecipitation again using methanol, and then the precipitates were isolated and dried. Thus, 2.93 g of white-colored graft polyarylate (5) was prepared.

The graft polyarylate (5) had a weight average molecular weight of 153,100 when measured by GPC.

Synthesis Example 6

Synthesis of Bisphenol E-Form Polycarbonate

At first, 30.0 mg (0.2 mmol) of 4-t-butylphenol (i.e., a molecular weight controlling agent), 6.00 g (150 mmol) of sodium hydrate, and 9.0 mg (0.5 mmol) of hydrosulfite were dissolved in 120 ml of water, and then 4.28 g (20 mmol) of 4,4'-ethylidynebisphenol was added thereto at room temperature. Thus, an aqueous phase was prepared.

On the other hand, 3.56 g (12 mmol) of triphosgene was dissolved in 10 ml of dichloromethane. Thus, an organic phase was prepared.

The aqueous phase was contained in a reaction vessel, and then the organic phase was added thereto at 15° C. The mixture was agitated for 15 minutes. Further, 20.2 mg (0.2 mmol) of triethylamine was added thereto as a catalyst, and then the mixture was subjected to a reaction for 90 minutes at room temperature. The mixture was diluted with dichloromethane, and then the organic phase was separated. The organic phase was firstly washed with water, secondly washed with a 2% aqueous solution of hydrochloric acid, and finally washed with water for 3 times. The organic phase was subjected to reprecipitation using methanol, and then the precipitates were isolated and dried. Thus, 4.16 g of a polycarbonate (6) was prepared.

The polymerization yield was 97.5%. The polycarbonate (6) had a weight average molecular weight of 151,500 when measured by GPC.

Synthesis Example 7

Synthesis of Vinylpyridine Graft Bisphenol E-Form Polycarbonate

At first, 3.0 g of the bisphenol E-form polycarbonate (6), 0.3 g of 4-vinylpyrydine, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polycarbonate was prepared.

Next, the crude graft polycarbonate was dissolved in dichloromethane, and then water was added thereto so as to wash the organic phase (i.e., dichloromethane phase). The organic phase was subjected to reprecipitation again using methanol, and then the precipitates were isolated and dried. Thus, 2.95 g of a pale yellowish-white-colored graft polycarbonate (7) was prepared.

The graft polycarbonate (7) had a weight average molecular weight of 150,500 when measured by GPC. It was clear from H-NMR analysis that 1 unit of vinylpyridine was grafted to 630 units of bisphenol E-form carbonate. This graft amount was calculated from an integration value of 4 protons of vinylpyridine ring and that of 8 protons of benzene ring.

Synthesis Example 8

Synthesis of Tetrabromobisphenol A-Form/Bisphenol Z-Form Polycarbonate Copolymer At first, 30.0 mg (0.2 mmol) of 4-t-butylphenol (i.e., a molecular weight controlling agent), 6.00 g (150 mmol) of sodium hydrate, and 9.0 mg (0.5 mmol) of hydrosulfite were dissolved in 120 ml of water, and then 5.43 g (10 mmol) of tetrabromobisphenol A and 2.68 g (10 mmol) of 1,1'-bis(4-hydroxyphenyl)cyclohexane were added thereto at room temperature. Thus, an aqueous phase was prepared.

On the other hand, 3.56 g (12 mmol) of triphosgene was dissolved in 10 ml of dichloromethane. Thus, an organic phase was prepared.

The aqueous phase was contained in a reaction vessel, and then the organic phase was added thereto at 15° C. The mixture was agitated for 15 minutes. Further, 20.2 mg (0.2 mmol) of triethylamine was added thereto as a catalyst, and then the mixture was subjected to a reaction for 90 minutes at room temperature. The mixture was diluted with dichloromethane, and then the organic phase was separated. The organic phase was firstly washed with water, secondly washed with a 2% aqueous solution of hydrochloric acid, and finally washed with water for 3 times. The organic phase was subjected to reprecipitation using methanol, and then the precipitates were isolated and dried. Thus, 7.86 g of a polycarbonate copolymer (8) was prepared.

The polymerization yield was 97.0%. The polycarbonate copolymer (8) had a weight average molecular weight of 161,000 when measured by GPC.

Synthesis Example 9

Synthesis of Acrylic Acid Graft Tetrabromobisphenol A-Form/Bisphenol Z-Form Polycarbonate Copolymer At first, 3.0 g of the tetrabromobisphenol A-form/bisphenol Z-form polycarbonate copolymer (8), 0.3 g of acrylic acid, and 0.1 g of dried BPO (benzoyl peroxide) were added to 40 ml of dehydrated toluene, and the mixture was heated to 100° C. and agitated for 5 hours under argon gas atmosphere. The mixture was then cooled to room temperature, and diluted with dichloromethane, and subjected to reprecipitation using methanol. Thus, a crude graft polycarbonate copolymer was prepared.

Next, the crude graft polycarbonate copolymer was dissolved in dichloromethane, and then water was added thereto so as to wash the organic phase (i.e., dichloromethane phase). The organic phase was subjected to reprecipitation again using methanol, and then the precipitates were isolated and dried. Thus, 2.94 g of white-colored graft polycarbonate copolymer (9) was prepared.

The graft polycarbonate copolymer (9) had a weight average molecular weight of 159,500 when measured by GPC.

GPC Measurement

The above reaction products were subjected to GPC measurement using an instrument HLC-8120 (from Tosoh Corporation) equipped with a pre-column TSKgrandcolumn SuperH-H (from Tosoh Corporation) and columns TSKgel SuperH5000, H4000, H3000, and H1000 (from Tosoh Corporation), which were connected with each other. The column temperature was 40° C., the carrier was tetrahydrofuran, and the flow rate was 0.6 ml/min. The average molecular weight was calculated using standard polystyrene.

Example 1

Formation of Undercoat Layer

The following components were mixed to prepare an undercoat layer coating liquid.

| | |
|---|---|
| Alkyd resin (BEKKOZOL 1307-60-EL from Dainippon Ink & Chemicals, Inc.) | 3 parts |
| Melamine resin (SUPER BEKKAMIN G-821-60 from Dainippon Ink & Chemicals, Inc.) | 2 parts |
| Titanium oxide (CR-EL from Ishihara Sangyo Kaisha, Ltd.) | 20 parts |
| Methyl ethyl ketone | 100 parts |

The undercoat layer coating liquid was coated on an aluminum cylinder having an outside diameter of 30 mm by a dip coating method, and then dried. Thus, an undercoat layer having a thickness of 3.5 μm was formed.

Formation of Photosensitive Layer

The following components were mixed to prepare a photosensitive layer coating liquid.

| | |
|---|---|
| Vinylpyridine graft bisphenol Z-form polycarbonate (1) (prepared in Synthesis Example 1) | 10 parts |
| Positive hole transport material having the formula (a) | 6 parts |

(a)

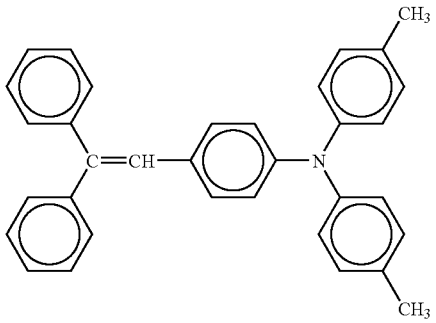

| | |
|---|---|
| Electron transport material having the formula (b) | 4 parts |

-continued (b)

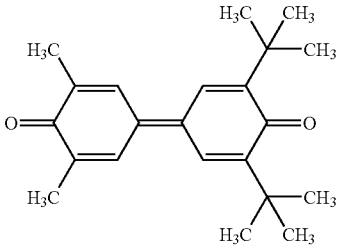

| | |
|---|---|
| Oxotitanium phthalocyanine | 0.4 parts |

(having an X-ray diffraction spectrum in which a highest peak is observed at Bragg 2θ angle of 27.2°±0.2° when a specific X-ray of Cu—Kα having a wavelength of 1.541 Å irradiates)

| | |
|---|---|
| Silica powder (KMPX100 from Shin-Etsu Chemical Co., Ltd.) | 5 parts |
| Tetrahydrofuran | 100 parts |
| Cyclohexanone | 4 parts |

The photosensitive layer coating liquid was coated on the undercoat layer by a dip coating method, and then dried. Thus, a photosensitive layer having a thickness of 25 μm was formed.

Thus, a photoreceptor of Example 1 was prepared.

Example 2

The procedure for formation of the undercoat layer in Example 1 was repeated. Thus, a undercoat layer was prepared.

Formation of CGL

The following components were mixed to prepare a CGL coating liquid.

| | |
|---|---|
| Azo pigment having the following formula | 5 parts |

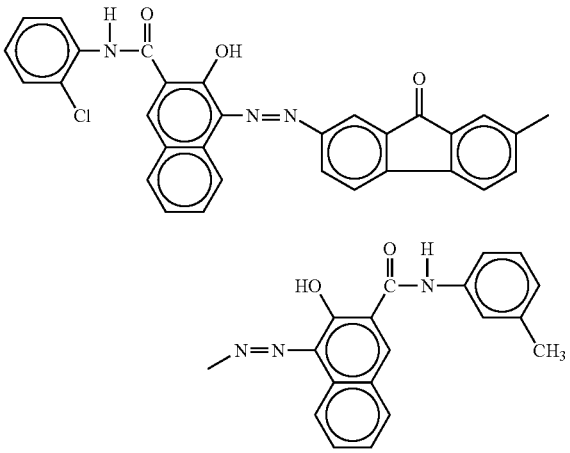

| | |
|---|---|
| Polyvinyl butyral (XYHL from UCC) | 1 part |
| 2-Butanone | 100 parts |
| Cyclohexanone | 200 parts |

The CGL coating liquid was coated on the undercoat layer by a dip coating method, and then heated to dry the coated liquid. Thus, a CGL having a thickness of 0.2 μm was formed.

Formation of CTL

The following components were mixed to prepare a CTL coating liquid.

| | |
|---|---|
| Vinylpyridine graft bisphenol Z-form polycarbonate (1) (prepared in Synthesis Example 1) | 10 parts |
| Positive hole transport material having the formula (a) | 10 parts |
| Silica powder (KMPX100 from Shin-Etsu Chemical Co., Ltd.) | 4 parts |
| Tetrahydrofuran | 110 parts |

The CTL coating liquid was coated on the CGL by a dip coating method, and then heated to dry the coated liquid. Thus, a CTL having a thickness of 27 μm was formed.

Thus, a photoreceptor of Example 2 was prepared.

Example 3

The procedure for formation of the undercoat layer and the CGL in Example 2 was repeated. Thus, an undercoat layer and a CGL were prepared.

Formation of CTL

The following components were mixed to prepare a CTL coating liquid.

| | |
|---|---|
| Bisphenol Z-form polycarbonate | 1 part |
| Positive hole transport material having the formula (a) | 1 part |
| Tetrahydrofuran | 10 parts |

The CTL coating liquid was coated on the CGL by a dip coating method, and then heated to dry the coated liquid. Thus, a CTL having a thickness of 22 μm was formed.

Formation of Protective Layer

The following components were mixed to prepare a protective layer coating liquid.

| | |
|---|---|
| Vinylpyridine graft bisphenol Z-form polycarbonate (1) (prepared in Synthesis Example 1) | 4 parts |
| Positive hole transport material having the formula (a) | 3 parts |
| Silica powder (KMPX100 from Shin-Etsu Chemical Co., Ltd.) | 3 parts |
| Tetrahydrofuran | 150 parts |
| Cyclohexanone | 60 parts |

The protective layer coating liquid was coated on the CTL by a spray coating method, and then heated at 150° C. for 20 minutes to dry the coated liquid.

The conditions of the spray coating were as follows.

(1) Spray gun: A-100 (manufactured by Meiji Machine Co., Ltd.)

(2) Discharge rate: 15 cc/min (3) Discharging pressure: 3.0 kg/cm$^2$ (4) Rotation number of photoreceptor: 150 rpm (5) Feeding speed of spray gun: 17 mm/sec (6) Distance between spray gun and photoreceptor: 5 cm (7) Number of times of spray coating operation: 3 times Thus, a protective layer was formed.

Thus, a photoreceptor of Example 3 was prepared.

Example 4

The procedure for preparation of the photoreceptor in Example 3 was repeated except that the discharge rate was changed to 17 cc/min, the discharging pressure was changed to 2.5 kg/cm$^2$, and the spray gun feeding speed was changed to 14 mm/sec.

Thus, a photoreceptor of Example 4 was prepared.

Example 5

The procedure for preparation of the photoreceptor in Example 3 was repeated except that the discharge rate was changed to 12 cc/min and the spray coating operation was performed 4 times.

Thus, a photoreceptor of Example 5 was prepared.

Example 6

The procedure for preparation of the photoreceptor in Example 3 was repeated except that the discharge rate was changed to 9 cc/min, the photoreceptor rotation number was changed to 120 rpm, the spray gun feeding speed was changed to 16 mm/sec, and the spray coating operation was performed 5 times.

Thus, a photoreceptor of Example 6 was prepared.

Example 7

The procedure for preparation of the photoreceptor in Example 3 was repeated except that the discharge rate was changed to 26 cc/min, the discharging pressure was changed to 2.5 kg/cm$^2$, the spray gun feeding speed was changed to 10 mm/sec, and the spray coating operation was performed once.

Thus, a photoreceptor of Example 7 was prepared.

Example 8

The procedure for preparation of the photoreceptor in Example 3 was repeated except that the discharge rate was changed to 16 cc/min, the discharging pressure was changed to 2.0 kg/cm$^2$, the photoreceptor rotation number was changed to 250 rpm, the spray gun feeding speed was changed to 18 mm/sec, and the protective layer coating liquid was replaced with the following.

| Protective Layer Coating Liquid | |
|---|---|
| Acrylic acid graft bisphenol Z-form polyarylate (5) (prepared in Synthesis Example 5) | 4 parts |
| Positive hole transport material having the formula (a) | 3 parts |
| Alumina powder (AA03 from Sumitomo Chemical Co., Ltd.) | 3 parts |
| Tetrahydrofuran | 170 parts |
| Methyl phenyl ether | 50 parts |

Thus, a photoreceptor of Example 8 was prepared.

Example 9

The procedure for preparation of the photoreceptor in Example 8 was repeated except that the discharge rate was changed to 14 cc/min, the discharging pressure was changed to 1.8 kg/cm$^2$, and the spray gun feeding speed was changed to 15 mm/sec.

Thus, a photoreceptor of Example 9 was prepared.

Example 10

The procedure for preparation of the photoreceptor in Example 8 was repeated except that the discharge rate was changed to 12 cc/min, the spray gun feeding speed was changed to 17 mm/sec, and the spray coating operation was performed 4 times.

Thus, a photoreceptor of Example 10 was prepared.

Example 11

The procedure for preparation of the photoreceptor in Example 8 was repeated except that the discharge rate was changed to 9 cc/min, the spray gun feeding speed was changed to 15 mm/sec, and the spray coating operation was performed 5 times.

Thus, a photoreceptor of Example 11 was prepared.

Example 12

The procedure for preparation of the photoreceptor in Example 8 was repeated except that the discharge rate was changed to 24 cc/min, the spray gun feeding speed was changed to 10 mm/sec, and the spray coating operation was performed once.

Thus, a photoreceptor of Example 12 was prepared.

Example 13

The procedure for preparation of the photoreceptor in Example 3 was repeated except that the discharge rate was changed to 18 cc/min, the discharging pressure was changed to 2.0 kg/cm$^2$, the photoreceptor rotation number was changed to 250 rpm, the spray gun feeding speed was changed to 18 mm/sec, the spray coating operation was performed twice, and the protective layer coating liquid was replaced with the following.

| Protective Layer Coating Liquid | |
|---|---|
| Vinylpyridine graft bisphenol E-form polycarbonate (7) (prepared in Synthesis Example 7) | 4.5 parts |
| Positive hole transport material having the formula (a) | 3.5 parts |
| Titania powder (CR97 from Ishihara Sangyo Kaisha Ltd.) | 2 parts |
| Tetrahydrofuran | 170 parts |
| Cyclohexanone | 50 parts |

Thus, a photoreceptor of Example 13 was prepared.

Example 14

The procedure for preparation of the photoreceptor in Example 13 was repeated except that the discharge rate was changed to 16 cc/min, the spray gun feeding speed was changed to 20 ml/sec, and the spray coating operation was performed 3 times.

Thus, a photoreceptor of Example 14 was prepared.

Example 15

The procedure for preparation of the photoreceptor in Example 13 was repeated except that the discharge rate was changed to 25 cc/min, the spray gun feeding speed was changed to 11 mm/sec, and the spray coating operation was performed once.

Thus, a photoreceptor of Example 15 was prepared.

Example 16

The procedure for preparation of the photoreceptor in Example 8 was repeated except that the CTL coating liquid was replaced with the following.

| CTL Coating Liquid | |
|---|---|
| Bisphenol A-form polycarbonate | 1 part |
| Positive hole transport material having the formula (a) | 1 part |
| Dichloroethane | 12 parts |

Thus, a photoreceptor of Example 16 was prepared.

Comparative Example 1

The procedure for preparation of the photoreceptor in Example 1 was repeated except that the vinylpyridine graft bisphenol Z-form polycarbonate (1) in the photosensitive layer coating liquid was replaced with a bisphenol Z-form polycarbonate (PANLITE® TS2050 from Teijin Chemicals Ltd.).

Thus, a photoreceptor of Comparative Example 1 was prepared.

Comparative Example 2

The procedure for preparation of the photoreceptor in Comparative Example 1 was repeated except that 0.05 parts of a dispersing agent (NIKKOL TAMNS-10 from Nikko Chemicals Co., Ltd.) and 4 parts of cyclohexanone were further added to the photosensitive layer coating liquid.

Thus, a photoreceptor of Comparative Example 2 was prepared.

Comparative Example 3

The procedure for preparation of the photoreceptor in Example 2 was repeated except that the vinylpyridine graft bisphenol Z-form polycarbonate (1) in the CTL coating liquid was replaced with a bisphenol Z-form polycarbonate (PANLITE® TS2050 from Teijin Chemicals Ltd.).

Thus, a photoreceptor of Comparative Example 3 was prepared.

Comparative Example 4

The procedure for preparation of the photoreceptor in Comparative Example 3 was repeated except that 0.04 parts of a dispersing agent (NIKKOL TAMNS-0 from Nikko Chemicals Co., Ltd.) were further added to the CTL coating liquid.

Thus, a photoreceptor of Comparative Example 4 was prepared.

Comparative Example 5

The procedure for preparation of the photoreceptor in Example 8 was repeated except that the acrylic acid graft bisphenol Z-form polyarylate (5) in the protective layer coating liquid was replaced with a bisphenol Z-form polycarbonate (PANLITE® TS2050 from Teijin Chemicals Ltd.).

Thus, a photoreceptor of Comparative Example 5 was prepared.

Comparative Example 6

The procedure for preparation of the photoreceptor in Comparative Example 5 was repeated except that 0.06 parts of a dispersing agent (BYKP104 from BYK-Chemie) were further added to the protective layer coating liquid.

Thus, a photoreceptor of Comparative Example 6 was prepared.

Comparative Example 7

The procedure for preparation of the photoreceptor in Example 3 was repeated except that the protective layer coating liquid was replaced with the following.

| Protective Layer Coating Liquid | |
|---|---|
| Bisphenol Z-form polycarbonate (PANLITE ® TS2050 from Teijin Chemicals Ltd.) | 4 parts |
| Positive hole transport material having the formula (a) | 3 parts |
| Silica (KMPX100 from Shin-Etsu Chemical Co., Ltd.) | 3 parts |
| Tetrahydrofuran | 170 parts |
| Cyclohexanone | 50 parts |

Thus, a photoreceptor of Comparative Example 7 was prepared.

Comparative Example 8

The procedure for preparation of the photoreceptor in Comparative Example 7 was repeated except that 0.03 parts of a dispersing agent (NIKKOL TAMNS-10 from Nikko Chemicals Co., Ltd.) were further added to the protective layer coating liquid.

Thus, a photoreceptor of Comparative Example 8 was prepared.

Comparative Example 9

The procedure for preparation of the photoreceptor in Example 13 was repeated except that the protective layer coating liquid was replaced with the following.

| Protective Layer Coating Liquid | |
|---|---|
| Bisphenol Z-form polyarylate (3) (prepared in Synthesis Example 3) | 4 parts |
| Positive hole transport material having the formula (a) | 4 parts |
| Titania powder (CR97 from Ishihara Sangyo Kaisha Ltd.) | 3 parts |
| Tetrahydrofuran | 170 parts |
| Cyclohexanone | 50 parts |

Thus, a photoreceptor of Comparative Example 9 was prepared.

Comparative Example 10

The procedure for preparation of the photoreceptor in Comparative Example 9 was repeated except that 0.03 parts of a dispersing agent (NIKKOL TAMNS-5 from Nikko Chemicals Co., Ltd.) were further added to the protective layer coating liquid.

Thus, a photoreceptor of Comparative Example 10 was prepared.

Comparative Example 11

The procedure for preparation of the photoreceptor in Example 3 was repeated except that the protective layer was not formed and the thickness of the CTL was changed to 27 μm.

Thus, a photoreceptor of Comparative Example 11 was prepared.

Evaluations (1) Dispersing Stability of Filler

In order to evaluate the dispersing stability of a filler, the photosensitive layer coating liquids of Example 1 and Comparative Examples 1 and 2, CTL coating liquids of Example 2 and Comparative Examples 3 and 4, and protective layer coating liquids of Examples 3, 8, and 13 and Comparative Examples 5 to 10, each including a filler, were subjected to a precipitation test in which 10 ml of a coating liquid was contained in a 10 ml precipitation tube and settled for 1 hour. After the 1-hour-settling, the coating liquid in the tube was visually observed and evaluated as follows.

Good: The upper part of a liquid was suspended. Good dispersing stability.

Average: The upper part of a liquid was slightly transparent. Poor dispersing stability.

Poor: The whole of a liquid was transparent. Very poor dispersing stability.

(2) Measurements of Average Maximum Thickness D of Protective Layer and Standard Deviation σ of the Maximum Thickness A cross section of each of the photoreceptors of Examples 3 to 16 and Comparative Examples 5 to 10 was observed by a scanning electron microscope to determine the average maximum thickness D and standard deviation σ of the maximum thickness.

(3) Ratio A/B

The procedures for preparation of the protective layers in Examples 3 to 16 and Comparative Examples 5 to 10 were repeated except that the protective layer was formed directly on the aluminum substrate to determine the ratio A/B thereof. The way to determine the ratio A/B is mentioned above.

(4) Running Test

Each of the photoreceptors of Examples 1 to 16 and Comparative Examples 1 to 11 was set in a copier, which is Imagio NEO271 manufactured by Ricoh Co., Ltd. and modified as mentioned below, to perform a running test in which 120,000 A4-size copies were produced.

a) light source of image irradiator: laser diode emitting light having a wavelength of 655 nm b) polygon mirror: used At the beginning and end of the running test, image qualities and quantity of abrasion of each protective layer were measured and evaluated.

With respect to image qualities, each of the produced half-tone images was visually observed by naked eyes and an optical microscope. The quality of the half-tone image was classified as follows.

Very good: excellent

Good: good but slightly uneven locally

Average: entire the half tone image is slightly uneven

Poor: uneven-density half tone image

The results are shown in Tables 1 to 4.

TABLE 1

| | Dispersing stability of filler |
|---|---|
| Example 1 | Good |
| Comparative Example 1 | Average |
| Comparative Example 2 | Average |
| Example 2 | Good |
| Comparative Example 3 | Average |
| Comparative Example 4 | Average |
| Example 3 | Good |
| Comparative Example 7 | Poor |
| Comparative Example 8 | Average |
| Example 8 | Good |
| Comparative Example 5 | Poor |
| Comparative Example 6 | Average |
| Example 13 | Good |
| Comparative Example 9 | Poor |
| Comparative Example 10 | Average |

TABLE 2

| | D (μm) | σ (μm) | A/B | Note |
|---|---|---|---|---|
| Ex. 3 | 6.10 | 1.11 | 1.89 | $D/7 < \sigma \leqq D/5$ |
| Ex. 4 | 6.05 | 0.98 | 1.75 | $D/7 < \sigma \leqq D/5$ |
| Ex. 5 | 6.07 | 0.85 | 1.52 | $\sigma \leqq D/7$ |
| Ex. 6 | 5.98 | 0.76 | 1.35 | $\sigma \leqq D/7$ |
| Ex. 7 | 6.14 | 1.38 | 2.15 | $D/5 < \sigma$ |
| Ex. 8 | 5.12 | 0.95 | 1.95 | $D/7 < \sigma \leqq D/5$ |
| Ex. 9 | 5.05 | 0.84 | 1.72 | $D/7 < \sigma \leqq D/5$ |
| Ex. 10 | 4.99 | 0.68 | 1.45 | $\sigma \leqq D/7$ |
| Ex. 11 | 5.21 | 0.58 | 1.24 | $\sigma \leqq D/7$ |
| Ex. 12 | 5.01 | 1.05 | 2.26 | $D/5 < \sigma$ |
| Ex. 13 | 3.02 | 0.55 | 1.91 | $D/7 < \sigma \leqq D/5$ |
| Ex. 14 | 3.11 | 0.38 | 1.27 | $\sigma \leqq D/7$ |
| Ex. 15 | 3.22 | 0.68 | 2.07 | $D/5 < \sigma$ |
| Ex. 16 | 5.09 | — | 1.89 | Discontinuous structure |
| Comp. Ex. 5 | 5.02 | 0.91 | 1.96 | $D/7 < \sigma \leqq D/5$ |
| Comp. Ex. 6 | 5.11 | 0.96 | 1.95 | $D/7 < \sigma \leqq D/5$ |
| Comp. Ex. 7 | 6.07 | 1.13 | 1.90 | $D/7 < \sigma \leqq D/5$ |
| Comp. Ex. 8 | 6.05 | 1.09 | 1.87 | $D/7 < \sigma \leqq D/5$ |
| Comp. Ex. 9 | 3.05 | 0.56 | 1.92 | $D/7 < \sigma \leqq D/5$ |
| Comp. Ex. 10 | 3.11 | 0.55 | 1.94 | $D/7 < \sigma \leqq D/5$ |

TABLE 3

| | Image quality | | |
|---|---|---|---|
| | At the beginning of the running | $50000^{th}$ image | $100000^{th}$ image |
| Ex. 1 | Very Good | Very Good | Very Good |
| Ex. 2 | Very Good | Very Good | Very Good |
| Ex. 3 | Very Good | Very Good | Good |
| Ex. 4 | Very Good | Very Good | Good |
| Ex. 5 | Very Good | Very Good | Very Good |
| Ex. 6 | Very Good | Very Good | Very Good |
| Ex. 7 | Good | Good | Average |
| Ex. 8 | Very Good | Good | Good |
| Ex. 9 | Very Good | Very Good | Good |
| Ex. 10 | Very Good | Very Good | Very Good |
| Ex. 11 | Very Good | Very Good | Very Good |
| Ex. 12 | Good | Average | Average |
| Ex. 13 | Very Good | Good | Good |
| Ex. 14 | Very Good | Very Good | Good |
| Ex. 15 | Good | Good | Average |
| Ex. 16 | Very Good | Very Good | — |
| Comp. Ex. 1 | Average | Average | Poor |
| Comp. Ex. 2 | Very good | Good | Average |
| Comp. Ex. 3 | Average | Average | Poor |

TABLE 3-continued

| | Image quality | | |
|---|---|---|---|
| | At the beginning of the running | $50000^{th}$ image | $100000^{th}$ image |
| Comp. Ex. 4 | Very good | Good | Average |
| Comp. Ex. 5 | Average | Poor | Poor |
| Comp. Ex. 6 | Very good | Good | Average |
| Comp. Ex. 7 | Average | Average | Poor |
| Comp. Ex. 8 | Very good | Average | Poor |
| Comp. Ex. 9 | Good | Average | Average |
| Comp. Ex. 10 | Very good | Good | Average |
| Comp. Ex. 11 | Very good | Very good | — |

TABLE 4

| | Abrasion quantity (μm) | |
|---|---|---|
| | $50000^{th}$ image | $100000^{th}$ image |
| Ex. 1 | 3.12 | 6.30 |
| Ex. 2 | 2.14 | 4.30 |
| Ex. 3 | 1.65 | 3.50 |
| Ex. 4 | 1.63 | 3.28 |
| Ex. 5 | 1.68 | 3.33 |
| Ex. 6 | 1.60 | 3.22 |
| Ex. 7 | 1.72 | 3.53 |
| Ex. 8 | 1.21 | 2.42 |
| Ex. 9 | 1.19 | 2.52 |
| Ex. 10 | 1.17 | 2.40 |
| Ex. 11 | 1.20 | 2.44 |
| Ex. 12 | 1.25 | 2.55 |
| Ex. 13 | 1.45 | 3.02 |
| Ex. 14 | 1.43 | 2.87 |
| Ex. 15 | 1.46 | 2.95 |
| Ex. 16 | 1.52 | Not produced due to protective layer peeling occurred when $80000^{th}$ image was produced. |
| Comp. Ex. 1 | 3.31 | 6.67 |
| Comp. Ex. 2 | 3.21 | 6.36 |
| Comp. Ex. 3 | 1.71 | 3.44 |
| Comp. Ex. 4 | 1.65 | 3.28 |
| Comp. Ex. 5 | 1.32 | 2.65 |
| Comp. Ex. 6 | 1.28 | 2.60 |
| Comp. Ex. 7 | 1.59 | 3.24 |
| Comp. Ex. 8 | 1.57 | 3.22 |
| Comp. Ex. 9 | 1.46 | 2.96 |
| Comp. Ex. 10 | 1.42 | 2.85 |
| Comp. Ex. 11 | 8.31 | 16.72 |

This document claims priority and contains subject matter related to Japanese Patent Applications Nos. 2006-139273, 2006-139275, and 2006-233068, filed on May 18, 2006, May 18, 2006, and Aug. 30, 2006, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate; and a photosensitive layer located overlying the electroconductive substrate, wherein an outermost layer of the electrophotographic photoreceptor comprises:

a resin comprising a graft copolymer in which a monomer having a polar group is graft polymerized to a polycarbonate resin, a polyarylate resin or a copolymer thereof; wherein the monomer having a polar group is selected from acrylic acid or vinylpyridine; and a filler;

wherein the polycarbonate resin, polyarylate resin or copolymer thereof is a resin consisting of units of bisphenol compounds having the following formula (1) optionally having an alkyl group:

$$HO—X—OH \quad (1)$$

wherein X represents a divalent group having the following formulae (2) or (3):

(2)

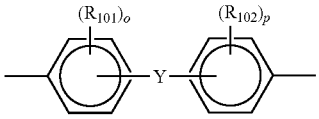

(3)

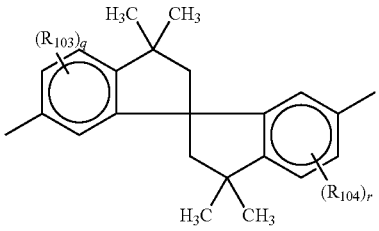

wherein each of $R_{101}$, $R_{102}$, $R_{103}$, and $R_{104}$ independently represents a halogen atom, an unsubstituted alkyl group having 1 to 6 carbon atoms, or an unsubstituted aryl group; each of o and p independently represents an integer of 0 to 4; each of q and r independently represents an integer of 0 to 3; Y represents a single bond, a linear alkylene group having 2 to 4 carbon atoms, —O—, —S—, or a functional group selected from groups having formulae (4) to (7):

(4)

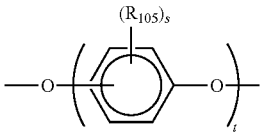

wherein $R_{105}$ represents a halogen atom, an unsubstituted alkyl group or alkoxy group having 1 to 6 carbon atoms, or an unsubstituted aryl group; s represents an integer of 0 to 4 and t represents a positive integer;

(5)

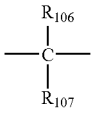

wherein each of $R_{106}$ and $R_{107}$ independently represents a hydrogen atom, a halogen atom, an unsubstituted alkyl group or alkoxy group having 1 to 6 carbon atoms, or an unsubstituted aryl group, wherein $R_{106}$ and $R_{107}$ optionally share bond connectivity to form a carbon ring having 5 to 12 carbon atoms;

(6)

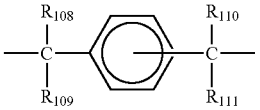

wherein each of $R_{108}$, $R_{109}$, $R_{110}$, and $R_{111}$ independently represents a hydrogen atom, a halogen atom, an unsubstituted alkyl group or alkoxy group having 1 to 6 carbon atoms, or an unsubstituted aryl group; and (7)

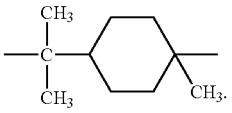

2. The electrophotographic photoreceptor according to claim 1, further comprising a protective layer located overlying the photosensitive layer.

3. The electrophotographic photoreceptor according to claim 2, wherein the protective layer and the photosensitive layer have a continuous structure, and wherein the protective layer satisfies the following relationship:

$$\sigma \leqq D/5$$

wherein D represents an average of maximum thicknesses of the protective layer in units of micrometers in 20 segments of 5 μm wide when a portion of a cross section of the photoreceptor of 100 μm wide is divided into 20 segments, and σ represents a standard deviation of the 20 maximum thicknesses.

4. The electrophotographic photoreceptor according to claim 3, wherein the protective layer satisfies the following relationship:

$$\sigma \leqq D/7.$$

5. The electrophotographic photoreceptor according to claim 1, wherein the filler comprises an inorganic filler.

6. The electrophotographic photoreceptor according to claim 5, wherein the inorganic filler comprises silica or a metal oxide.

7. The electrophotographic photoreceptor according to claim 6, wherein the inorganic filler is the metal oxide and the metal oxide comprises a material selected from the group consisting of titanium oxide and aluminum oxide.

8. An image forming apparatus, comprising:

a photoreceptor;

a charger configured to charge the photoreceptor;

an image irradiator configured to irradiate the photoreceptor with a light beam to form an electrostatic latent image on the photoreceptor;

an image developer configured to develop the electrostatic latent image with a toner to form a toner image on the photoreceptor; and a transfer belt configured to transfer the toner image onto a receiving material optionally via an intermediate transfer medium, wherein the photoreceptor is the electrophotographic photoreceptor according to claim 1.

9. The image forming apparatus according to claim 8, wherein the electrophotographic photoreceptor further comprises a protective layer located overlying the photosensitive layer.

10. The image forming apparatus according to claim 9, wherein the protective layer and the photosensitive layer have a continuous structure, and wherein the protective layer satisfies the following relationship:

$$\sigma \leqq D/5$$

wherein D represents an average of maximum thicknesses of the protective layer in units of micrometers in 20 segments of 5 μm wide when a portion of a cross section of the photoreceptor of 100 μm wide is divided into 20 segments, and a represents a standard deviation of the 20 maximum thicknesses.

11. The image forming apparatus according to claim 10, wherein the protective layer satisfies the following relationship:

$$\sigma \leqq D/7.$$

12. A process cartridge for an image forming apparatus, comprising:

the electrophotographic photoreceptor according to claim 1;

a housing containing the electrophotographic photoreceptor; and optionally, one or more members selected from the group consisting of a charger, an image irradiator, an image developer, an image transferrer, a cleaner and a discharger.

13. The process cartridge for an image forming apparatus according to claim 12, wherein the electrophotographic photoreceptor further comprises a protective layer located overlying the photosensitive layer.

14. The process cartridge for an image forming apparatus according to claim 13, wherein the protective layer and the photosensitive layer have a continuous structure, and wherein the protective layer satisfies the following relationship:

$$\sigma \leqq D/5$$

wherein D represents an average of maximum thicknesses of the protective layer in units of micrometers in 20 segments of 5 μm wide when a portion of a cross section of the photoreceptor of 100 μm wide is divided into 20 segments, and σ represents a standard deviation of the 20 maximum thicknesses.

15. The process cartridge for an image forming apparatus according to claim 14, wherein the protective layer satisfies the following relationship:

$$\sigma \leqq D/7.$$

16. The electrophotographic photoconductor as claimed in claim 1, wherein the resin is a member selected from the group consisting of vinylpyridine graft bisphenol Z-form polycarbonate, acrylic acid graft bisphenol Z-form polycarbonate, vinylpyridine graft bisphenol Z-form polyarylate, acrylic acid graft bisphenol Z-form polyarylate, vinylpyridine graft bisphenol E-form polycarbonate, and acrylic acid graft tetrabromobisphenol A-form/bisphenol Z-form polycarbonate copolymer.

* * * * *